US011203503B2

(12) United States Patent
Shimada

(10) Patent No.: US 11,203,503 B2
(45) Date of Patent: Dec. 21, 2021

(54) SHEET DISCHARGING DEVICE, METHOD OF CONTROLLING SHEET DISCHARGING DEVICE, PROCESSING DEVICE, AND RECORDING SYSTEM

(71) Applicant: SEIKO EPSON CORPORATION, Tokyo (JP)

(72) Inventor: Chiaki Shimada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/034,337

(22) Filed: Sep. 28, 2020

(65) Prior Publication Data

US 2021/0094787 A1 Apr. 1, 2021

(30) Foreign Application Priority Data

Sep. 30, 2019 (JP) ..... JP2019-179220

(51) Int. Cl.
*B65H 31/30* (2006.01)
*B65H 7/02* (2006.01)

(52) U.S. Cl.
CPC ..... *B65H 31/3009* (2013.01); *B65H 7/02* (2013.01); *B65H 31/3027* (2013.01); *B65H 2301/42261* (2013.01); *B65H 2301/422615* (2013.01)

(58) Field of Classification Search
None
See application file for complete search history.

(56) References Cited

U.S. PATENT DOCUMENTS 4,511,297 A * 4/1985 Wilson ..... B42C 19/02 156/356
4,611,741 A * 9/1986 Wilson ..... B42C 1/12 227/99
5,964,459 A * 10/1999 Yamanaka ..... B42C 1/12 270/58.08
6,349,934 B1 2/2002 Ishiguro et al.
6,450,934 B1 * 9/2002 Coombs ..... B42C 1/12 270/58.12
6,722,650 B1 * 4/2004 Abbata ..... B65H 29/34 271/213
7,216,863 B2 * 5/2007 Kuwata ..... G03G 15/6547 270/58.11

(Continued)

FOREIGN PATENT DOCUMENTS

JP 2000-086049 3/2000
JP 2000-289914 10/2000

(Continued)

*Primary Examiner* — Leslie A Nicholson, III
(74) *Attorney, Agent, or Firm* — Workman Nydegger

(57) ABSTRACT

A sheet discharging device includes: a medium supporting portion configured to support a transported medium, the medium supporting portion being configured to swing; a stacking portion which is provided vertically below the medium supporting portion and on which the medium dropped from the medium supporting portion is stacked, the stacking portion being configured to move up and down; and a detecting portion that detects swinging of the medium supporting portion, in which the detecting portion detects the swinging of the medium supporting portion when the medium on the rising stacking portion comes into contact with a lower surface of the medium supporting portion.

9 Claims, 13 Drawing Sheets

(56) References Cited

U.S. PATENT DOCUMENTS

| | | | | |
|---|---|---|---|---|
| 7,389,979 | B2 * | 6/2008 | Kaneko | B42C 1/12 270/37 |
| 7,823,868 | B2 * | 11/2010 | Taki | B65H 31/36 270/58.09 |
| 7,883,081 | B2 * | 2/2011 | Iguchi | B65H 31/02 270/58.17 |
| 2006/0066021 | A1 * | 3/2006 | Sasahara | B65H 29/44 270/58.11 |
| 2006/0066040 | A1 * | 3/2006 | Terao | B65H 29/52 270/58.11 |
| 2020/0156895 | A1 * | 5/2020 | Tsuchiya | B65H 29/34 |
| 2020/0207567 | A1 * | 7/2020 | Uchibori | B65H 31/3081 |

FOREIGN PATENT DOCUMENTS

| | | |
|---|---|---|
| JP | 2010-247957 | 11/2010 |
| JP | 2012-188226 | 10/2012 |
| JP | 2013-052937 | 3/2013 |

* cited by examiner

SHEET DISCHARGING DEVICE, METHOD OF CONTROLLING SHEET DISCHARGING DEVICE, PROCESSING DEVICE, AND RECORDING SYSTEM

The present application is based on, and claims priority from JP Application Serial Number 2019-179220, filed Sep. 30, 2019, the disclosure of which is hereby incorporated by reference herein in its entirety.

BACKGROUND

1. Technical Field

The present disclosure relates to a sheet discharging device including a medium supporting portion that supports at least a tip portion of a transported medium and a stacking portion that stacks the medium dropped from the medium supporting portion, a method of controlling the sheet discharging device, a processing device including the sheet discharging device, and a recording system including the processing device.

2. Related Art

JP-A-2013-52937 discloses a processing device having a structure which includes a jogger stacking portion having a pair of left and right joggers that support, arrange, and stack a transported medium and in which the pair of left and right joggers are opened to drop and stack the bundle of the arranged medium on a stacking tray.

For example, a medium printed by an ink jet printer or the like may be curled during transport, and the curling may hinder the transport of the medium. Further, the curling may inhibit stacking of the medium on a stacking portion. Since the curling often grows, the transport and the stacking of the medium are more likely to be hindered.

However, in JP-A-2013-52937, there is no description and no suggestion that is made considering a problem when the transported medium is curled.

SUMMARY

A sheet discharging device of the present disclosure for solving the above-described problems includes: a swingable medium supporting portion that supports a medium transported in a transport direction; an elevatable stacking portion which is provided vertically below the medium supporting portion and on which the medium dropped from the medium supporting portion is stacked; and a detecting portion that detects swinging of the medium supporting portion, in which the detecting portion detects the swinging of the medium supporting portion when the medium on the rising stacking portion comes into contact with a lower surface of the medium supporting portion.

DESCRIPTION OF EXEMPLARY EMBODIMENTS

Figure 1:
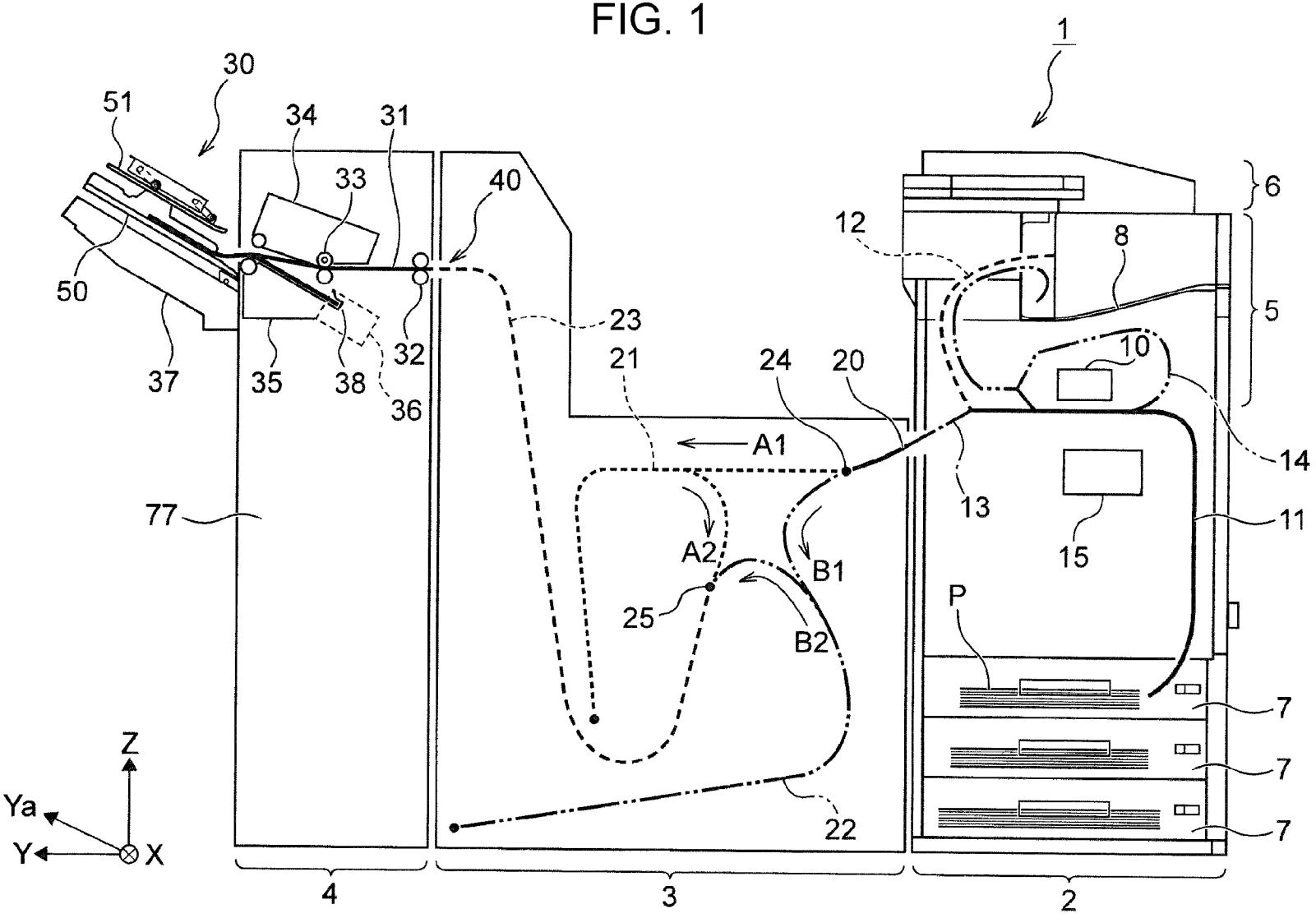
FIG. 1 is a schematic view illustrating a recording system of the present embodiment.
Figure 2:
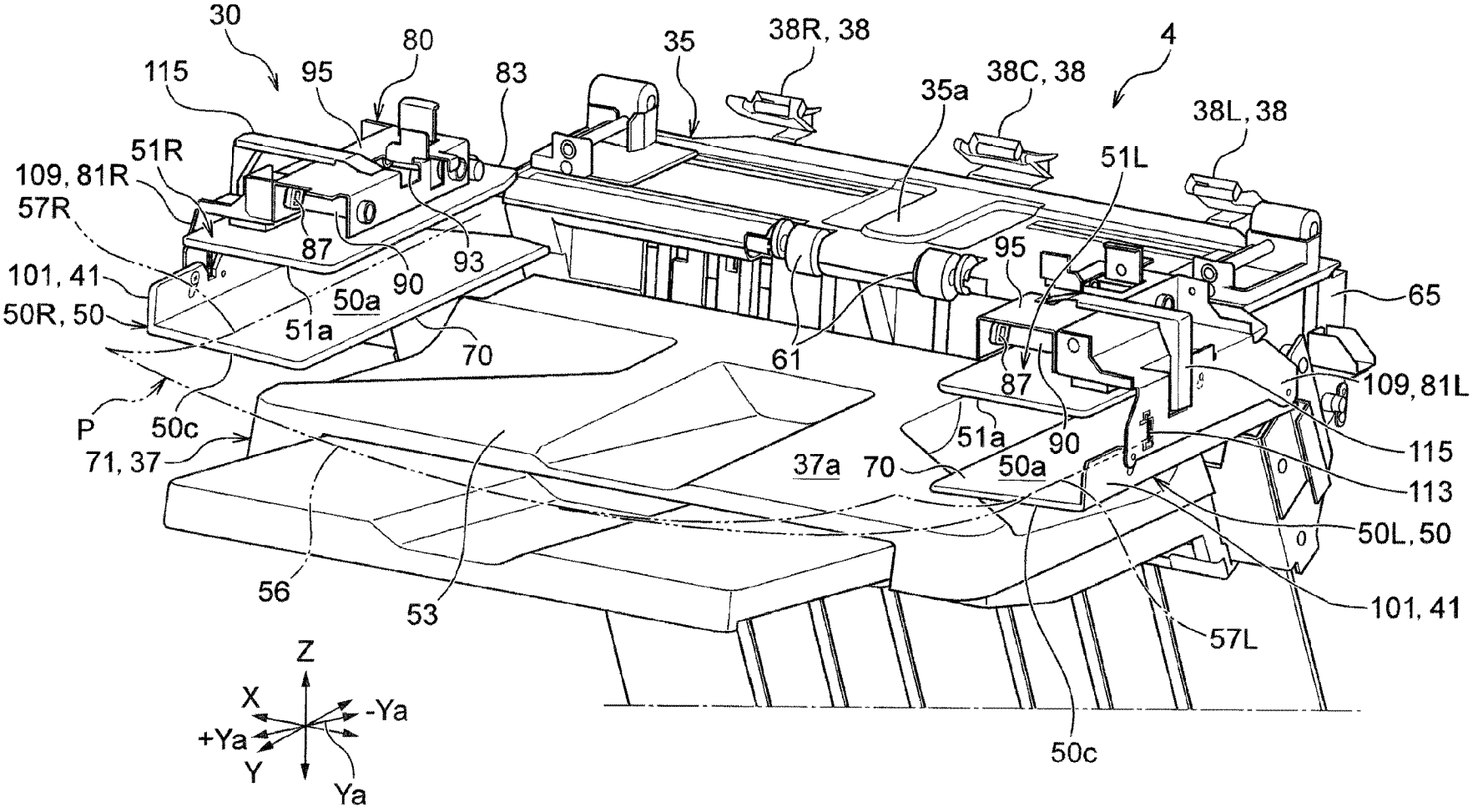
FIG. 2 is a perspective view illustrating a processing device of the present embodiment.

First, the present disclosure will be briefly described.

A sheet discharging device according to a first aspect of the present disclosure for solving the above-described problems includes: a medium supporting portion configured to support a medium transported in a transport direction, the medium supporting portion being configured to swing; a stacking portion which is provided vertically below the medium supporting portion and on which the medium dropped from the medium supporting portion is stacked, the stacking portion being configured to move up and down; and a detecting portion that detects swinging of the medium supporting portion, in which the detecting portion detects the swinging of the medium supporting portion when the medium on the rising stacking portion comes into contact with a lower surface of the medium supporting portion.

According to this aspect, the detecting portion detects the swinging of the medium supporting portion when the medium on the rising stacking portion comes into contact with the lower surface of the medium supporting portion. When the medium is flat without deformation such as curl, the medium does not come into contact with the lower surface of the medium supporting portion, and thus the medium supporting portion does not swing.

However, when the medium has the deformation such as curl, a portion deformed by the curl or the like firstly comes into contact with the lower surface of the medium supporting portion, the other portion does not come into contact with the lower surface of the medium supporting portion, and thus the medium supporting portion swings. The detecting portion can detect that the medium has the deformation such as curl due to the swinging. Further, it is possible to grasp the size of the deformation such as curl from a degree of the swinging and to cope with the deformation. That is, a distance by the stacking portion is lowered can be appropriately determined according to the size of the deformation such as curl, and the occurrence of problems such as stacking deviation caused by the contact between the medium stacked on the stacking portion and the medium supporting portion can be suppressed.

A second aspect of the present disclosure provides the sheet discharging device according to the first aspect, in which the medium supporting portion has a swinging center on an upstream in the transport direction, and includes a biasing member that biases the medium supporting portion on a downstream in the transport direction in a direction away from the stacking portion.

Here, setting is made in which in a state where the medium supporting portion vertically swings about the swinging center as a supporting point, a biasing force of the biasing member reduces a force of the medium supporting portion swinging vertically downward due to its own weight, and when the deformed portion of the medium having the deformation such as curl comes into contact with the medium supporting portion, the medium supporting portion can swing upward with a small force without crushing the curl. Further, from a practical view point, the biasing force does not need to be able to cope with curls of all types of mediums, and may be set to cope with the type of the medium that is expected to be used frequently in the sheet discharging device.

According to this aspect, since the medium supporting portion has the swinging center on an upstream in the transport direction and has a structure in which a downstream thereof is a free end that swings, it is possible to suppress the biasing force of the biasing member from becoming excessive as compared to a case where the structure is reversed. Further, since a downstream of the curl in the transport direction tends to increase, it is possible to easily cope with the tendency of the curl.

A third aspect of the present disclosure provides the sheet discharging device according to the first aspect or the second aspect, in which a pair of the medium supporting portions are provided at positions supporting both sides of the medium in a width direction intersecting the transport direction, and the detecting portion has: a flag lever that interlocks with the pair of swinging medium supporting portions; and a sensor that senses displacement of a flag provided on the flag lever.

According to this aspect, the detecting portion has the flag lever that interlocks with the swinging medium supporting portions and the sensor that senses the displacement of the flag provided on the flag lever. As described above, by using the sensor that senses the displacement of the flag of the flag lever, it is possible to detect the swinging of the medium supporting portion by a simple structure.

A fourth aspect of the present disclosure provides the sheet discharging device according to the third aspect, in which when supporting mediums having different widths, the pair of medium supporting portions are movable between a first position where the medium supporting portions are closest to each other in the width direction and a second position where the medium supporting portions are farthest away from each other, the flag lever includes an extension body that extends in the width direction, and the flag that protrudes from the extension body, and the extension body has a length that makes contact with the pair of medium supporting portions located at the second position.

According to this aspect, the extension body of the flag lever is formed to have a length that enables contact with the pair of medium supporting portions located at the second position. Accordingly, one sensor can detect the swinging of the pair of medium supporting portions.

A method of controlling a sheet discharging device according to a fifth aspect of the present disclosure is provided, the device including: a pair of medium supporting portions configured to support a medium transported in a transport direction, the medium supporting portion being configured to swing; a stacking portion which is provided vertically below the pair of medium supporting portions and on which the medium dropped by moving the pair of medium supporting portions in a width direction intersecting the transport direction is stacked, the stacking portion being configured to move up and down; and a detecting portion that detects swinging of the medium supporting portions, and the method including: supporting the transported medium by using the pair of medium supporting portions; dropping the medium supported by the pair of medium supporting portions by moving the pair of medium supporting portions in the width direction; receiving the dropped medium on the stacking portion and stacking the received medium on a stacking surface; after stacking, on the stacking surface, the medium dropped from the pair of medium supporting portions, moving the pair of medium supporting portions in a direction opposite to a direction at a time of the dropping, and stopping the medium supporting portions; bringing the medium on the stacking surface into contact with lower surfaces of the medium supporting portions by raising the stacking portion after stopping the pair of medium supporting portions; detecting presence or absence of the swinging of the medium supporting portions due to the contact; and lowering the stacking portion based on a detection result.

According to this aspect, the same effect as that of the first aspect can be obtained.

A sixth aspect of the present disclosure provides the method according to the fifth aspect, in which when the detection result indicates that there is no swinging, the stacking portion is lowered by a predetermined distance set in advance, and when the detection result indicates that there is the swinging, the stacking portion is lowered by a distance according to a degree of the swinging.

According to this aspect, when the detection result indicates that there is the swinging, the stacking portion is lowered by the distance according to the degree of the swinging. Accordingly, even when the deformation such as curl increases, the stacking portion is lowered by a distance corresponding to the size of the deformation, so that the stacking deviation caused by the contact between the medium on the stacking portion and the medium supporting portion can be suppressed.

A seventh aspect of the present disclosure provides the method according to the fifth aspect or the sixth aspect, further including lowering the stacking portion by a predetermined distance before moving the pair of medium supporting portions in a direction opposite to a direction at a time of the dropping.

According to this aspect, the stacking deviation caused by the contact between the medium on the stacking portion and the medium supporting portion can be further suppressed.

A processing device according to an eighth aspect of the present disclosure includes: a processing section that performs processing on a medium; a medium supporting portion configured to support the medium transported in a transport direction from the processing section, the medium supporting portion being configured to swing; a stacking portion which is provided vertically below the medium supporting portion and on which the medium dropped from the medium supporting portion is stacked, the stacking portion being configured to move up and down; and a detecting portion that detects swinging of the medium supporting portion, in which the detecting portion detects the swinging of the medium supporting portion when the medium on the rising stacking portion comes into contact with a lower surface of the medium supporting portion.

According to this aspect, the same effect as that of the first aspect can be obtained in the processing device.

A recording system according to a ninth aspect of the present disclosure includes: a recording device having a recording section that performs recording on a medium and a discharging portion that discharges the medium on which recording is performed by the recording section; and a processing device having a medium introducing portion that introduces the medium discharged from the discharging portion, a processing section that performs processing on the medium introduced from the medium introducing portion, a medium supporting portion configured to support the medium transported in a transport direction from the processing section, a stacking portion which is provided vertically below the medium supporting portion and on which the medium dropped from the medium supporting portion is stacked, the stacking portion being configured to move up and down, and a detecting portion that detects swinging of the medium supporting portion, in which the detecting portion detects the swinging of the medium supporting portion when the medium on the rising stacking portion comes into contact with a lower surface of the medium supporting portion.

According to this aspect, the same effect as that of the first aspect can be obtained in the recording system including the recording device.

Embodiment

Hereinafter, embodiments of the present disclosure will be described in detail with reference to the accompanying drawings.

An XYZ coordinate system illustrated in each drawing is a rectangular coordinate system, and an X-axis direction is the width direction of a medium P and is also the depth direction of each device. A Y-axis direction is the length direction of the medium P when the medium P is transversely transported and is the width direction of each device. A Z-axis direction is a thickness direction or a stacking height direction when the medium P is transversely placed, and indicates a vertical direction or the height direction of each device.

Further, a Ya-axis direction indicates a transport direction or a sheet discharging direction in a processing device or a sheet discharging device of the present embodiment, and +Ya indicates a downstream when the medium P is transported or discharged. Further, −Ya indicates an upstream opposite to the above. In the present embodiment, the Ya-axis direction is set to a direction in which the +Ya side has an upward inclination which is slightly higher in the Z-axis direction than in the transverse Y-axis direction.

Overall Configuration of Recording System

First, based on FIG. 1, an overall configuration of a recording system including the processing device having the sheet discharging device according to an embodiment of the present disclosure will be schematically described.

The recording system 1 according to the present embodiment includes: a recording device 2 having a recording section 10 that performs recording on a medium P such as a printing sheet and a discharge path 13 that is a discharging portion configured to discharge the medium P on which recording is performed by the recording section 10; and a processing device 4 having a medium introducing portion 40 that introduces the medium P discharged from the discharge path 13 that is a discharging portion, a processing section 36 that processes the medium P introduced from the medium introducing portion 40, a swingable medium supporting portion 50 that supports the medium P transported in a transport direction Ya via the processing section 36, an elevatable stacking portion 37 which is provided below the medium supporting portion 50 in a vertical direction Z and on which the medium P dropped from the medium supporting portion 50 is stacked, and a detecting portion 100 that detects swinging of the medium supporting portion 50, in which a stacking surface 37*a* of the stacking portion 37 is parallel to the lower surface 50*c* of the medium supporting portion 50.

The detecting portion 100 is configured to detect the swinging of the medium supporting portion 50 when the medium P on the rising stacking portion 37 comes into contact with the lower surface 50*c* of the medium supporting portion 50.

In detail, in the present embodiment, the recording system 1 is configured as illustrated in FIG. 1 as an example, and the recording device 2, an intermediate device 3, and the processing device 4 having a sheet discharging device 30 according to the present embodiment, which will be described below, are sequentially arranged from the right side to the left side of FIG. 1.

The recording device 2, the intermediate device 3, and the processing device 4 are connected to each other, and the medium P, which is supplied by the recording device 2 and on which recording is executed, is continuously transported and discharged until the medium P is introduced into the processing device 4 via the intermediate device 3 and is finally delivered to a stacking portion 37.

Hereinafter, a schematic configuration of each of the recording device 2, the intermediate device 3, and the processing device 4 will be described in this order.

Outline of Recording Device

The recording device 2 is configured as a compound machine including: a printer section 5 including a recording head (recording section) 10 that executes the recording by ejecting ink that is an example of liquid to a recording sheet that is an example of the medium P; and a scanner section 6 that reads an image on a document. In the present embodiment, the printer section 5 is configured as a so-called ink jet printer, and a line head that executes the recording in a width direction X of the medium P at once is adopted as an example of the recording head 10.

Further, a plurality of stages of medium accommodation cassettes 7 are provided at a lower portion of a main body of the recording device 2, and for example, a plurality of mediums P having different sizes are classified according to the size and are individually accommodated in these medium accommodation cassettes 7.

The medium P accommodated in the medium accommodation cassette 7 of each stage is sent to a recording area of the printer section 5 in which the recording head 10 exists through a supply path 11 indicated by a solid line in the recording device 2 of FIG. 1, and a desired recording operation is executed on the medium P. As an example, the medium P on which the recording is executed by the recording head 10 is supplied to either a first discharge path 12 in which the medium P is discharged toward a discharge tray 8 provided above the recording head 10 or a second discharge path 13 in which the medium P is discharged to the processing device 4 according to the present embodiment via the intermediate device 3.

Further, in FIG. 1, the first discharge path 12 is illustrated by a broken line, and the second discharge path 13 is illustrated by a dashed line.

Further, the printer section 5 of the recording device 2 also includes a reversing path 14 indicated by a two-dot chain line, and double-sided recording can be executed in which after the recording is executed on the front surface of the medium P, the medium P is reversed and the recording is continuously executed on the rear surface of the medium P.

Further, although not illustrated, one or more of transport roller pairs that apply a transport force to the medium P and a guide roller or a guide member that guides the transport of the medium P are appropriately arranged in each of the supply path 11, the first discharge path 12, the second discharge path 13, and the reversing path 14.

In addition, the recording device 2 is provided with: a manipulation panel that is not illustrated and is used when various pieces of information on the transport and the recording of the medium P are input; and a controller 15 that controls various operations related to the transport and the recording of the medium P based on the input various pieces of information.

Further, a structure in which the manipulation panel and the controller 15 are installed in each of the recording device 2, the intermediate device 3, and the processing device 4 may be provided or a structure in which the manipulation panel and the controller 15 are provided only in the recording device 2 to control the entire devices may be provided.

Outline of Intermediate Device

The intermediate device 3 is a device that receives, from the recording device 2, the medium P that has been recorded and is discharged through the second discharge path 13, and delivers the received medium P to the processing device 4.

The intermediate device 3 is provided with an intermediate reception path 20 indicated by a solid line in FIG. 1, through which the medium P that has been recorded and is discharged through the second discharge path 13 of the recording device 2 is received in a device body of the intermediate device 3.

Further, a branch portion 24 is provided at an end of the intermediate reception path 20, and two transport paths through which the medium P is transported with the branch portion 24 as a starting point are provided. Among them, a first transport path is a transport path from the intermediate reception path 20 via a first switchback path 21 to an intermediate discharge path 23.

Further, the first switchback path 21 is a path through which the medium P is received in an arrow A1 direction, is switched back in an arrow A2 direction, and then reaches the intermediate discharge path 23. A second switchback path 22 is a path through which the medium P is received in an arrow B1 direction, is switched back in an arrow B2 direction, and then reaches the intermediate discharge path 23.

Therefore, a merging section 25 is provided at ends of the first switchback path 21 and the second switchback path 22, and by the merging section 25, both the medium P sent to the first switchback path 21 and the medium P sent to the second switchback path 22 are guided to the common intermediate discharge path 23, so that the medium P can be delivered to the processing device 4 having the sheet discharging device 30, which will be described below.

Further, although not illustrated, one or more transport roller pairs that apply a transport force to the medium and a guide roller or a guide member that guides the transport of the medium P are appropriately arranged in each of the intermediate reception path 20, the first switchback path 21, the second switchback path 22, and the intermediate discharge path 23.

Further, when the recording is continuously performed on a plurality of the mediums P, the medium P received in the intermediate device 3 can be alternately sent to a transport path passing through the first switchback path 21 and a transport path passing through the second switchback path 22. By the way, with such a configuration, the throughput of the transport of the medium P in the intermediate device 3 can increase, and efficient intermediate transport can be realized.

Further, when the medium P recorded by the recording device 2 is sent to the processing device 4 via the intermediate device 3, a transport time is long as compared to a case where the medium P is directly sent from the recording device 2 to the processing device 4. Thus, it is possible to promote drying of ink ejected and attached onto the front surface or the rear surface of the medium P before being transported to the processing device 4.

Further, when the promotion of the drying of the ink is not required, the recording system 1 may include only the recording device 2 and the processing device 4 while the intermediate device 3 is omitted.

Outline of Processing Device

The processing device 4 is a device that collects, into a bundle, a plurality of mediums P on which the recording is performed by the recording device 2 and of which the drying is promoted by the intermediate device 3, executes a predetermined process on the mediums P after aligning the mediums P, and sequentially discharges and stacks the mediums P in the stacking portion 37 by the sheet discharging device 30.

Accordingly, the processing device 4 is provided with: a transport element that guides and aligns the medium P delivered from the intermediate device 3 into a main body of the processing device 4 and transports the medium P for discharging the medium P; a aligning element that collects and aligns the plurality of transported mediums P into a bundle; a processing element that executes a predetermined process such as a stapling process on the aligned mediums P; and a discharging/stacking element that discharges the processed mediums P and sequentially stacks the mediums P.

In the present embodiment, the transport element includes a transport path 31, a first transport roller pair 32, a second transport roller pair 33, a medium transport section 34, and a medium placement section 35. Further, the aligning element includes a rear end aligning section 38, a paddle mechanism 43 (FIG. 4), and a side end aligning section 41. The processing element includes the processing section 36 that performs a stapling process, a punching process, a folding process, and a saddle stitching process. The discharging/stacking element includes the sheet discharging device 30, the medium supporting portion 50, and the stacking portion 37.

Further, in the present embodiment, a detection element is provided which detects swinging of the medium supporting portion 50, generated when the medium P on the stacking portion 37 comes into contact with the lower surface 50*c* of the medium supporting portion 50, due to occurrence of a lateral curl in which a tip 56 of the medium P is curved upward and which is generated by swelling or transportation by execution of the recording of the recording device 2, a longitudinal curl in which left and right side ends 57L and 57R of a tip portion 53 of the medium P are curved upward, and a curl in which a central portion of the medium P is expanded and swelled upward by swelling by the ink.

Figure 3:
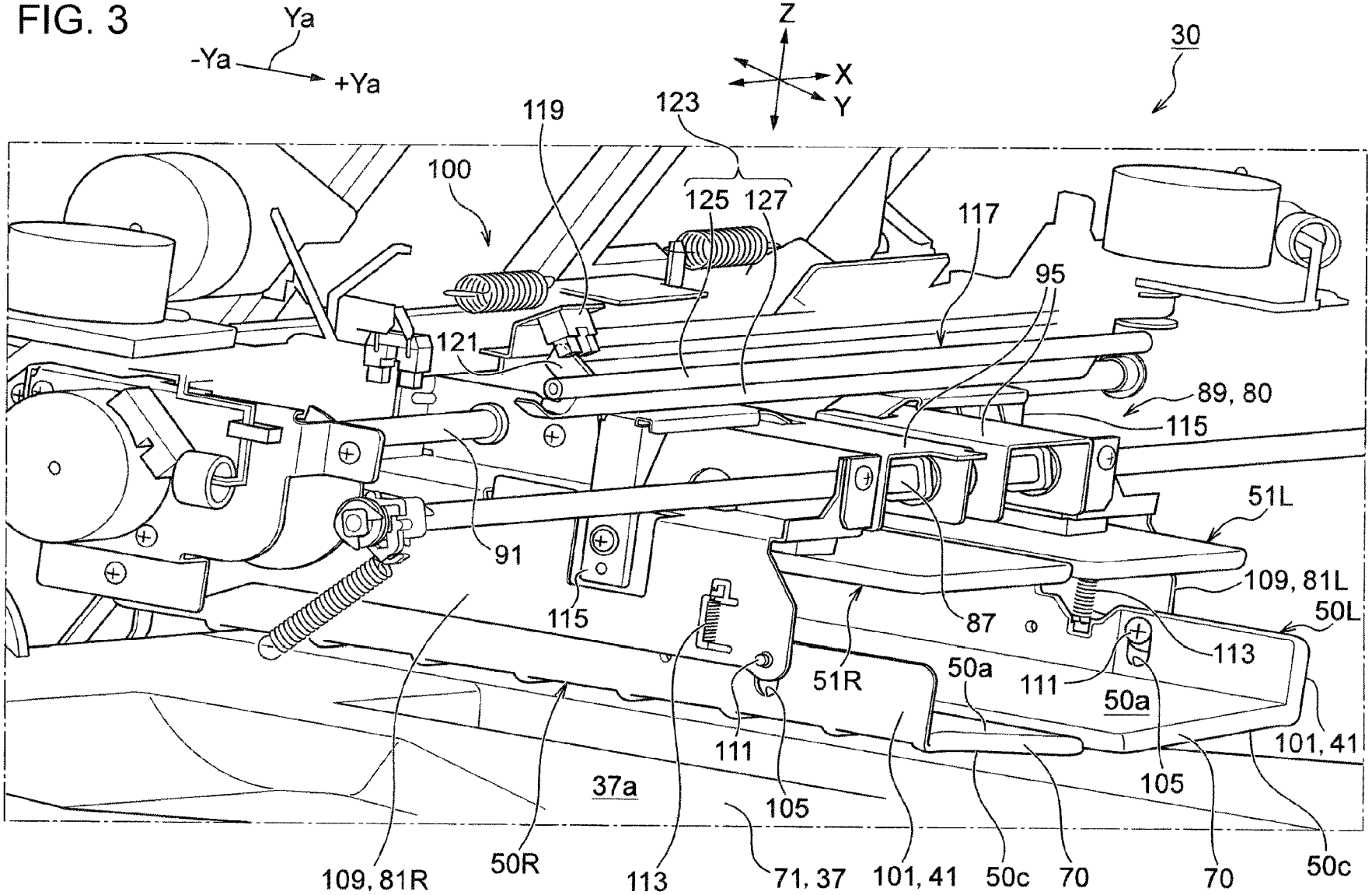
FIG. 3 is a perspective view illustrating a sheet discharging device according to the present embodiment, in a state in which a medium supporting portion is not swinging.
Figure 4:
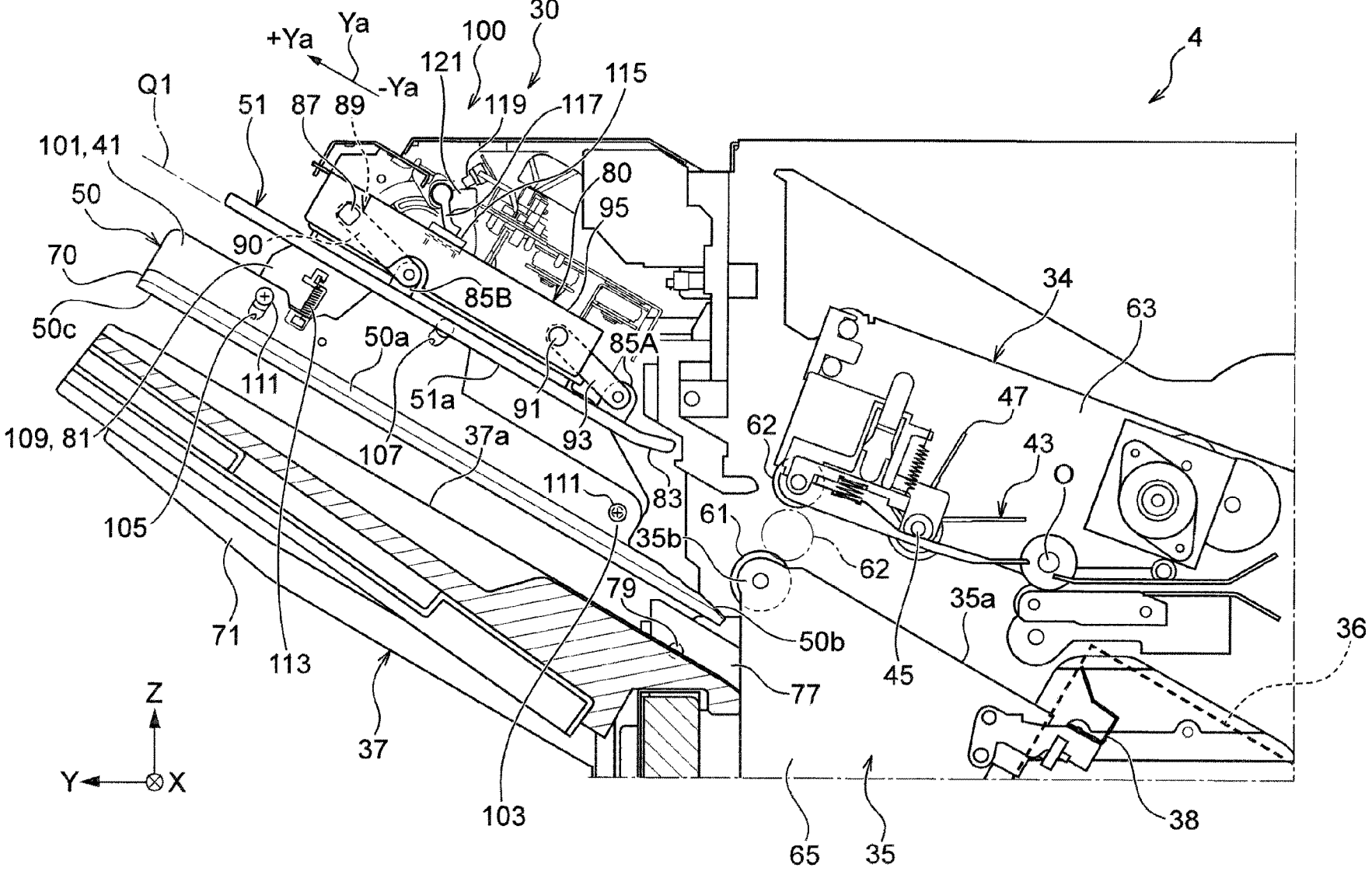
FIG. 4 is a side sectional view illustrating the processing device according to the present embodiment before a medium is received.

As illustrated in FIGS. 3 and 4, the detection element includes the medium supporting portion 50, the stacking portion 37, and the detecting portion 100.

Further, in the present embodiment, a pressing element that suppresses the occurrence of the curl or the like is also provided. The pressing element includes a pressing section 51 and the medium supporting portion 50.

Further, the medium introducing portion 40 of the processing device 4 is provided with the transport path 31 that guides the medium P delivered to the processing device 4 into a device body such that the medium P can be transported in a predetermined manner. Further, two transport roller pairs including the first transport roller pair 32 and the second transport roller pair 33 that apply a transport force to the medium P introduced into the device body are provided as an example on the transport path 31.

Hereinafter, a detailed configuration of the processing device 4 according to the present embodiment, configured by these respective elements, will be described in detail.

Detailed Configuration of Processing Device (FIGS. 1 to 12)

As illustrated in FIGS. 1 to 4, the processing device 4 according to the present embodiment includes: the processing section 36 that performs a predetermined process on the medium P; the swingable medium supporting portion 50 that supports the medium P transported in the transport direction Ya via the processing section 36; the elevatable stacking portion 37 which is provided below the medium supporting portion 50 in the vertical direction Z and on which the medium P dropped from the medium supporting portion 50 is stacked; and the detecting portion 100 that detects the swinging of the medium supporting portion 50.

As illustrated in FIG. 4, a stacking surface 37*a* of the stacking portion 37 is parallel to the lower surface 50*c* of the medium supporting portion 50, and the detecting portion 100 is configured to detect the swinging of the medium supporting portion 50 when the medium P on the rising stacking portion 37 comes into contact with the lower surface 50*c* of the medium supporting portion 50.

Figure 5:
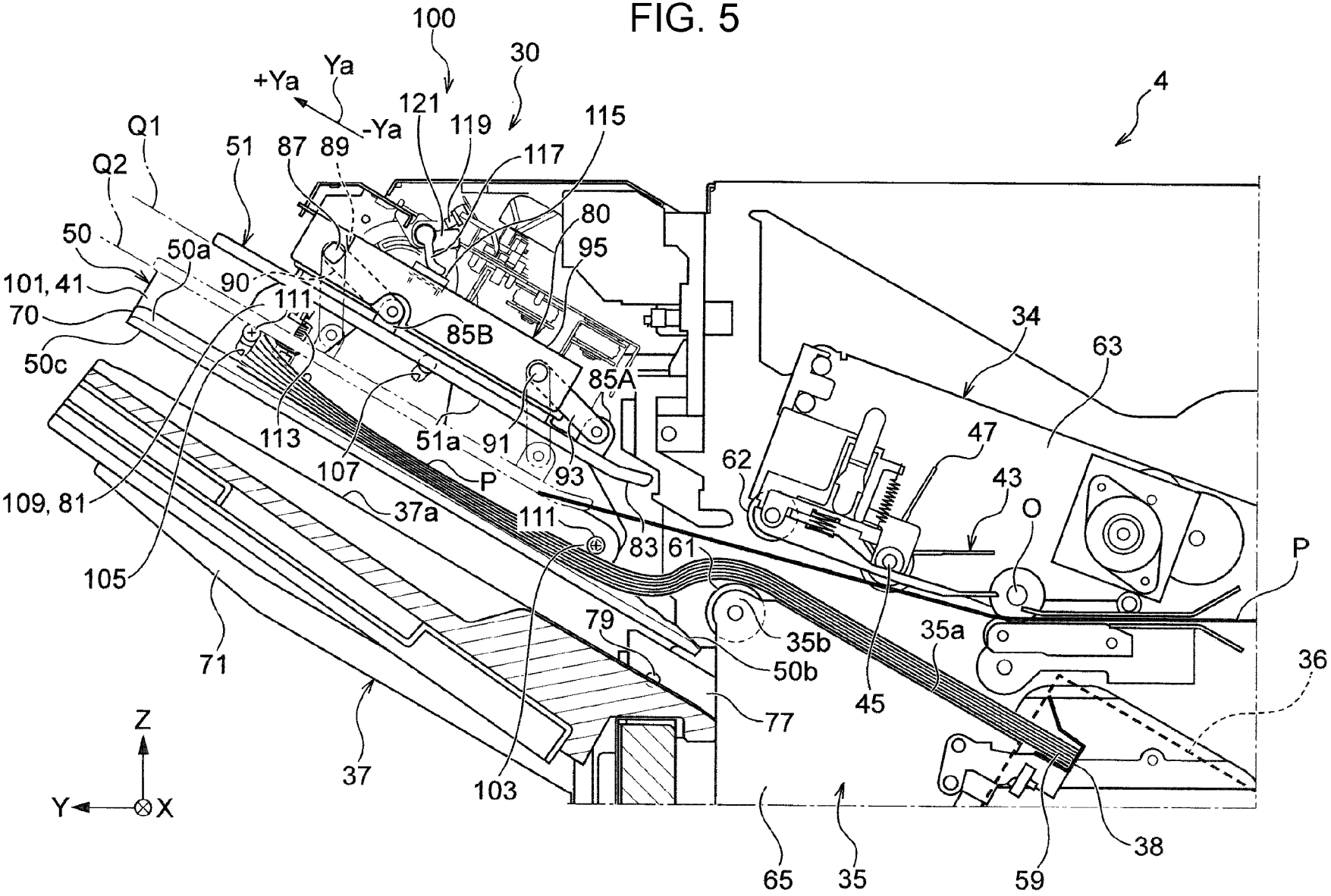
FIG. 5 is a side sectional view illustrating the processing device according to the present embodiment when the medium is received.
Figure 6:
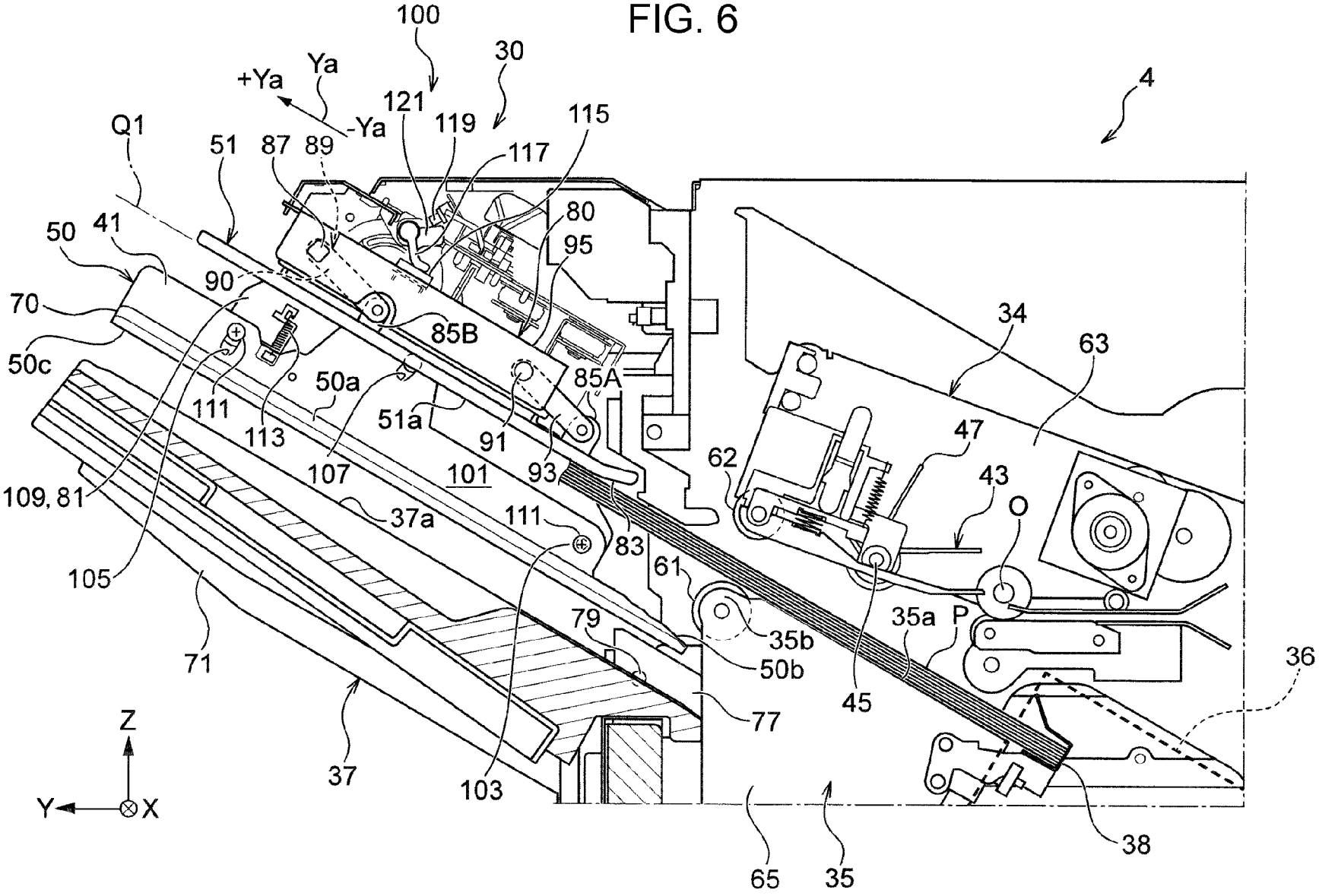
FIG. 6 is a side sectional view illustrating the processing device according to the present embodiment after the medium is aligned and processed.
Figure 7:
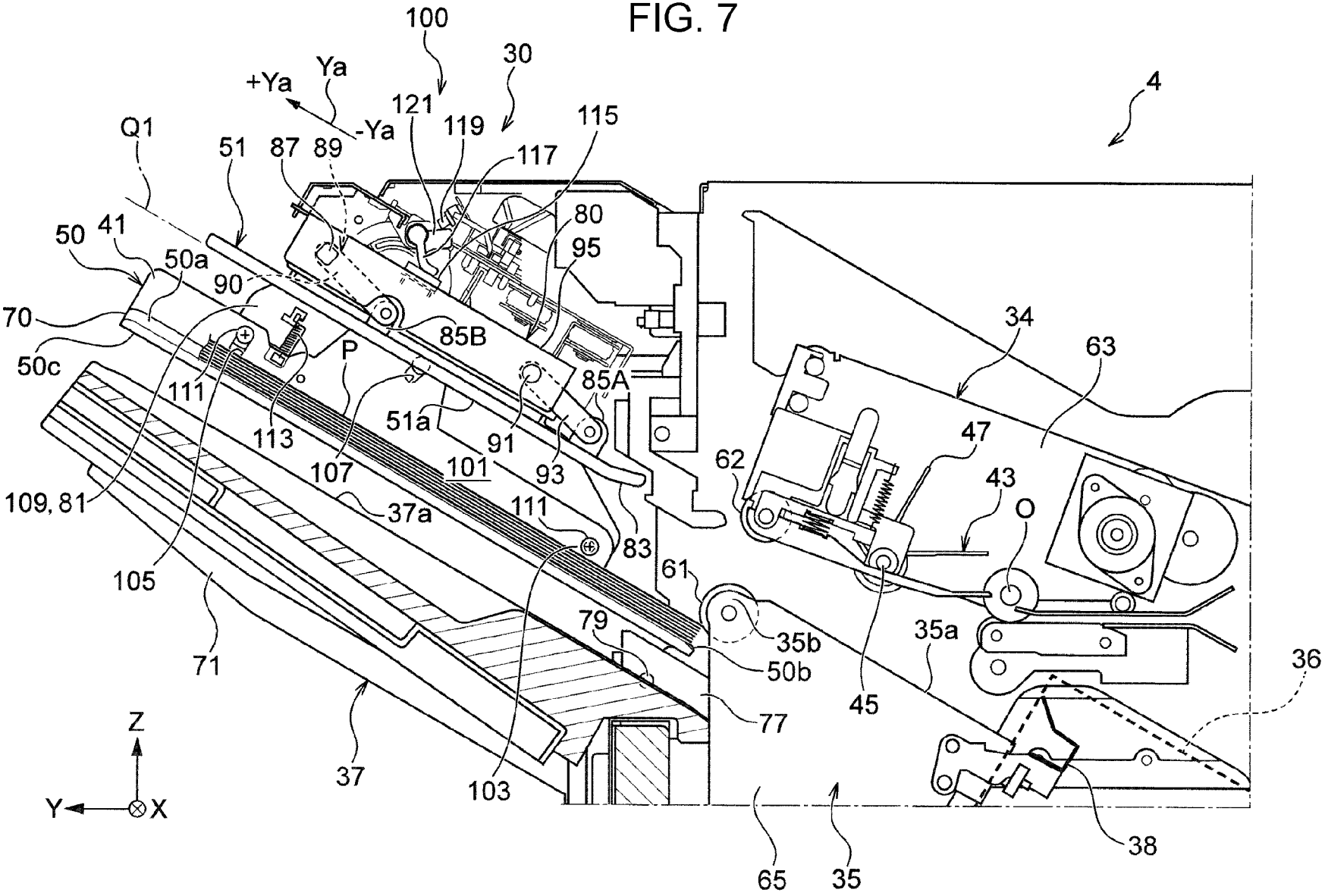
FIG. 7 is a side sectional view illustrating the processing device according to the present embodiment after the medium is discharged.
Figure 8:
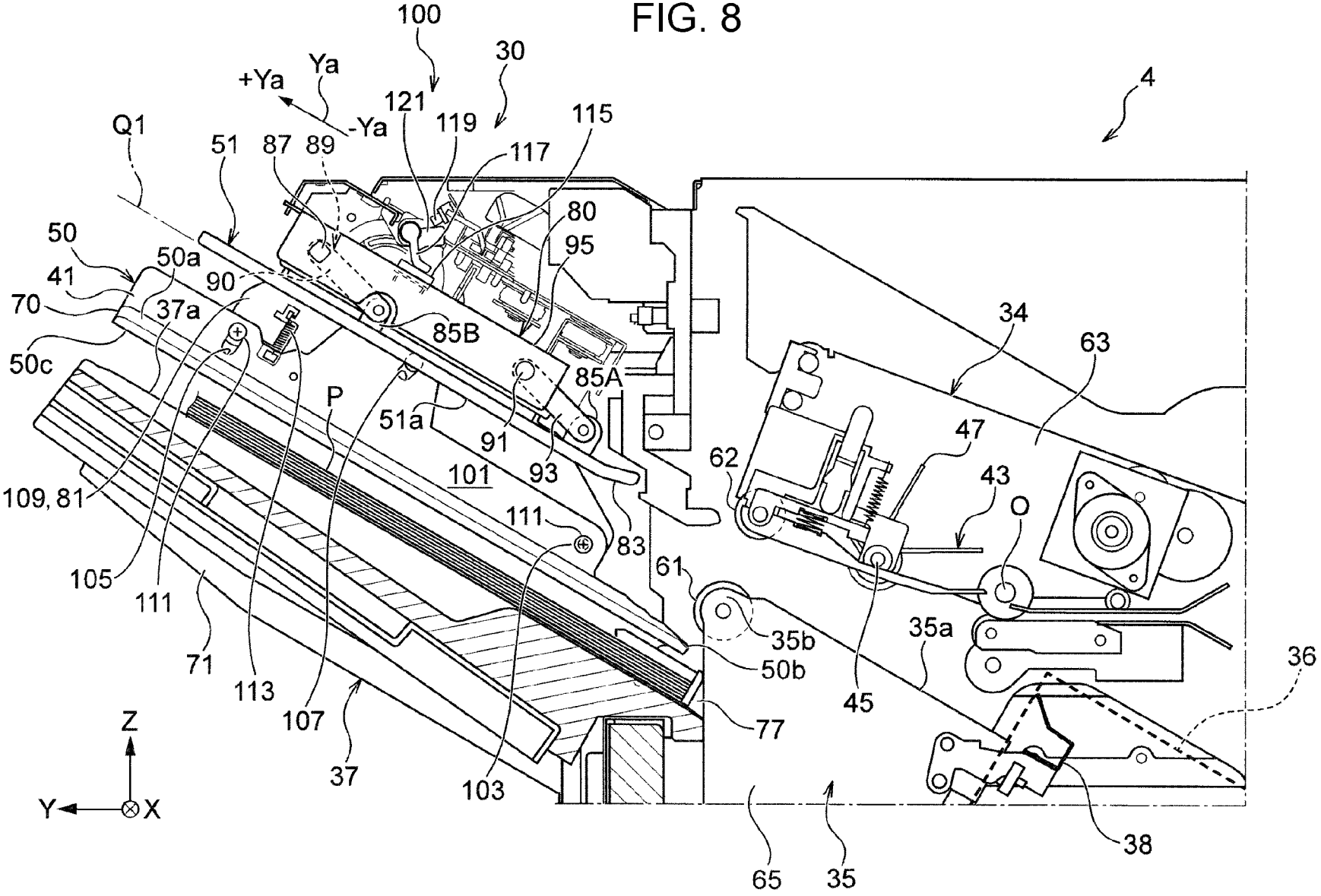
FIG. 8 is a side sectional view illustrating the processing device according to the present embodiment when the medium is stacked.
Figure 9:
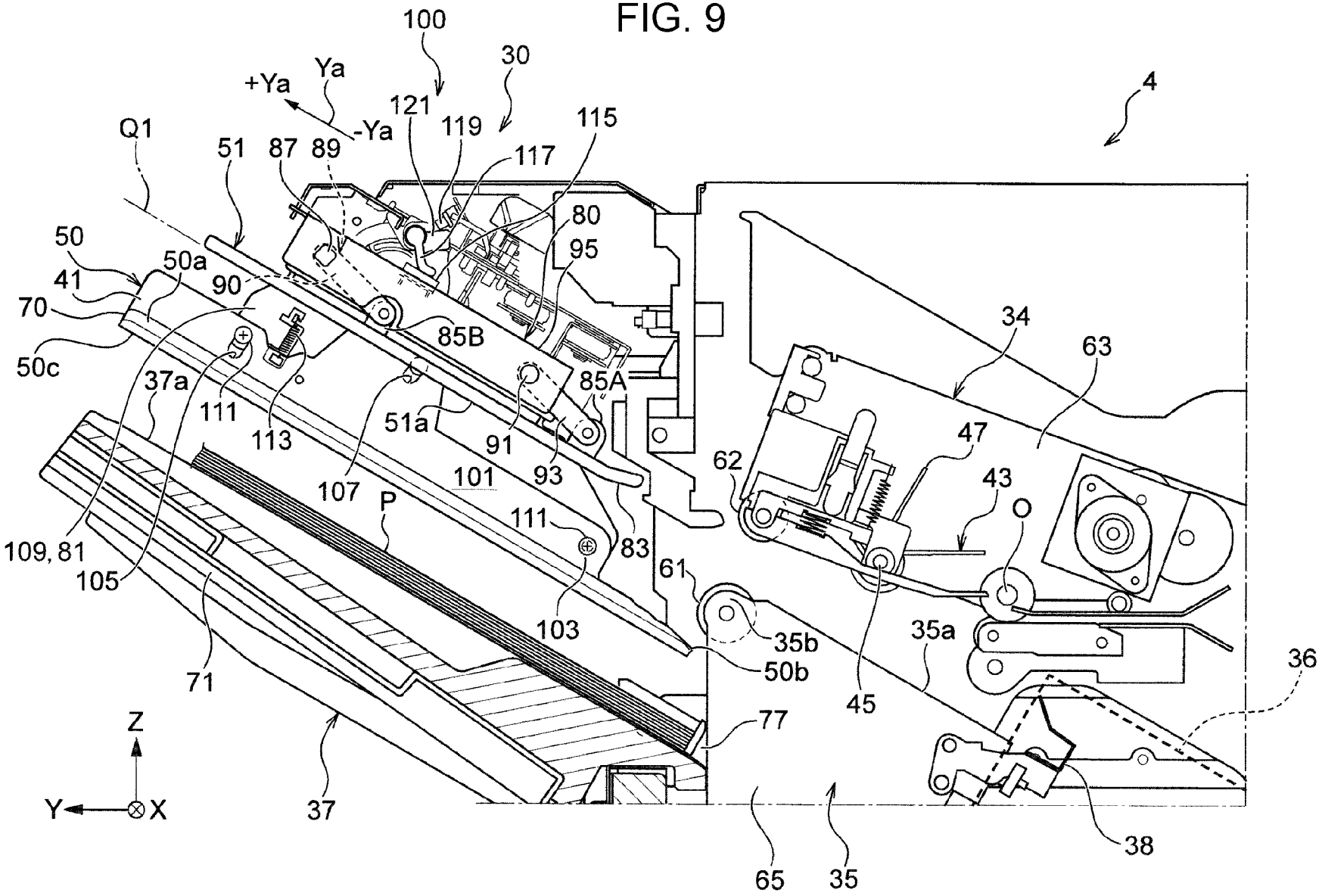
FIG. 9 is a side sectional view illustrating the processing device of the present embodiment after the medium is stacked.
Figure 10:
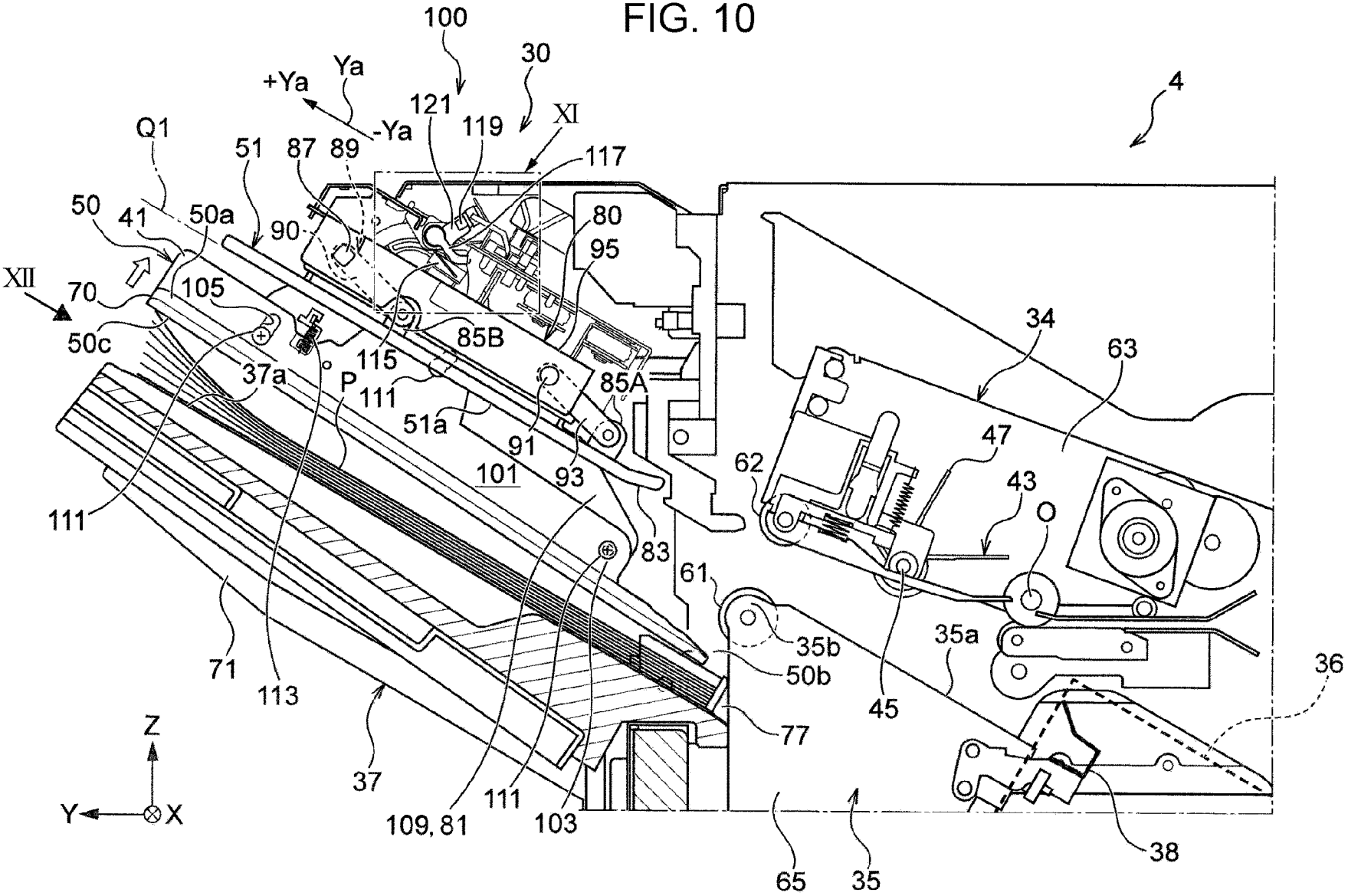
FIG. 10 is a side sectional view illustrating the sheet discharging device according to the present embodiment at a time of swinging detection.
Figure 11:
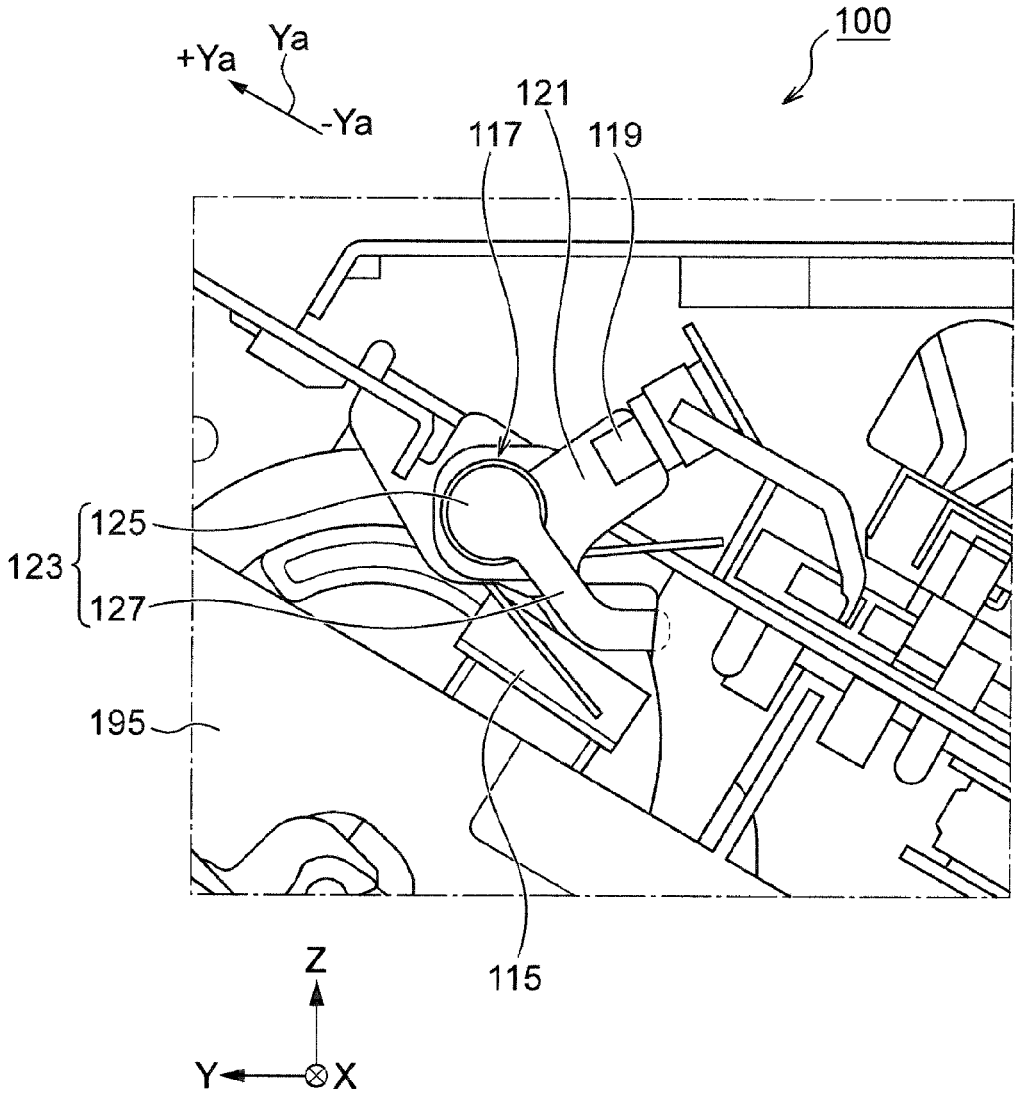
FIG. 11 is an enlarged view of part XI of FIG. 10 illustrating the sheet discharging device according to the present embodiment.

Further, as illustrated in FIGS. 4 and 5, in the present embodiment, the pressing section 51 is provided which has a pressing surface 51*a* facing a support surface 50*a* of the medium supporting portion 50 and in which the pressing surface 51*a* is movable between a retraction position Q1 and a pressed position Q2 where the pressing surface 51*a* is closer to the support surface 50*a* than the retraction position Q1. The pressing section 51 is configured to be located in the retraction position Q1 when the medium P is transported to the medium supporting portion 50 and to be located in the pressed position Q2 after the aligning section 38 aligns the medium P on the medium supporting portion 50.

Further, as illustrated in FIGS. 4 and 5, in the present embodiment, the medium placement section 35 having a placement surface 35*a* that can support a portion of the medium P transported from the intermediate device 3 on a rear end 59 side is provided at a −Ya position upstream of the medium supporting portion 50 in the transport direction Ya. Further, the medium transport section 34 including the paddle mechanism 43 that assists an operation of the aligning section 38 is provided above the medium placement section 35.

Further, the medium supporting portion 50 and the stacking portion 37 stack and hold the medium P discharged after being aligned and processed, and may thus be constituent members of the sheet discharging device 30. Hereinafter, constituent members of the above-described respective elements constituting the processing device 4 will be described in detail.

Transport Element

As illustrated in FIGS. 1 and 4, the transport element of the processing device 4 includes the transport path 31, the first transport roller pair 32, the second transport roller pair 33, the medium transport section 34, and the medium placement section 35.

In the present embodiment, as illustrated in FIG. 1, the transport path 31 is a transport path 31 which is disposed in the medium introducing portion 40 transversely in parallel to the Y direction and is upwardly inclined along the transport direction Ya corrected upward from a portion where the medium transport section 34 and the medium placement section 35 are arranged.

A first transport roller pair 32 including a pair of nip rollers is provided upstream (in the −Y direction) of a transverse portion of the transport path 31, and in the same manner, a second transport roller pair 33 including a pair of nip rollers is provided downstream (in the +Y direction) of the transverse portion.

The medium transport section 34 transports the bundle of the mediums P, which have been aligned and processed, from a position where a portion on the rear end 59 side exists on the placement surface 35*a* of the medium placement section 35 to a position where the portion on the rear end 59 side is located on the support surface 50*a* of the medium supporting portion 50.

The medium transport section 34 includes a swinging frame 63 that swings about a swinging supporting point O at a predetermined angle, and a transport driven roller 62 that is in contact with the upper surface of the bundle of the medium P and applies, to the medium P, a transport force to the downstream +Ya of the transport direction Ya by a nip operation between the transport driven roller 62 and a transport driving roller 61, which will be described below, is provided in a corner portion downstream of the lower surface of the swinging frame 63. Further, the paddle mechanism 43 for assisting the aligning, which will be described below, is also mounted on the medium transport section 34.

Further, a transport section that uses a transport belt bridged over by a plurality of rollers arranged in a loop shape or the like instead of the above-described set of the transport driving roller 61 and the transport driven roller 62 and further together uses a suction adsorption-type or electrostatic adsorption-type adsorption section using a negative pressure generated by a suction fan may be adopted as the medium transport section 34.

The medium placement section 35 is a member that supports the portion of the medium P on the rear end 59 side guided to the transport path 31 so that a aligning work described below is smoothly performed.

The medium placement section 35 has a housing 65 formed on the upper surface thereof and having the placement surface 35*a* inclined along a sheet discharging direction Ya. The transport driving roller 61, which constitutes a nip roller together with the transport driven roller 62 and applies a transport force to the medium P, is installed at the corner portion of an upper portion of the housing 65 at a downstream position. In addition, a motor that is not illustrated and applies a driving force to the transport driving roller 61, a power transmission section, and a movement section that moves the aligning section 38, which will be described below, to the downstream +Ya or the upstream −Ya in the sheet discharging direction Ya in which the medium supporting portion 50 exists are provided in the housing 65.

Aligning Element

The aligning element of the processing device 4 includes the rear end aligning section 38, a first side end aligning section that is not illustrated, the paddle mechanism 43, and the second side end aligning section 41. Further, the support surface 50*a* of the medium supporting portion 50 and the placement surface 35*a* of the medium placement section 35 exist as portions that support the medium P from below when the medium P is aligned.

The rear end aligning section 38 is a section that arranges and aligns the rear end 59 of the bundle of the plurality of mediums P supported by the placement surface 35*a* of the medium placement section 35. The rear end aligning section 38 is a member having an open end surface on the downstream +Ya side in the sheet discharging direction Ya and having a substantially U-shaped cross section. In the present embodiment, the rear end aligning section 38 is provided with three pairs of rear end aligning section 38L, 38R, and 38C arranged on left and right sides and a central side in the medium width direction X, respectively.

The pair of left and right first side end aligning sections are provided and right to pinch the medium P on the medium placement section 35 from the medium width direction X, and is configured to be able to perform a predetermined stroke and shift operation in the medium width direction X. Accordingly, the side edge of the medium P, which is supported by the placement surface 35*a* of the medium placement section 35, on the rear end 59 side can be aligned.

Further, the support surface 50*a* of the medium supporting portion 50 and the placement surface 35*a* of the medium placement section 35 are inclined surfaces that assist the rear end 59 of the medium P smoothly entering and being held in the rear end aligning section 38. The medium P slides down the support surface 50*a* and the placement surface 35*a* that are inclined surfaces by its own weight, and the rear end 59 of the medium P is smoothly guided into the rear end aligning section 38 and comes into contact with the bottom surface of the rear end aligning section 38, so that the medium P is arranged and aligned.

Further, the paddle mechanism 43 exists as a mechanism for assisting the movement of the medium P by its own weight.

The paddle mechanism 43 includes a rotary shaft 45 extending in the medium width direction X, a plurality of blades called paddles 47, which are provided around the rotary shaft 45 and are made of rubber, and a driving section that rotationally drives the rotary shaft 45 in a direction in which the rear end 59 of the medium P enters the rear end aligning section 38. Further, two sets of the paddles 47 configured by the plurality of blades are arranged at positions spaced apart from each other in the medium width direction X, and are provided to be movable in the medium width direction X.

The first side end aligning section and the second side end aligning section 41 are arranged on left and right sides of the medium transport section 34 and the medium placement section 35 to pinch the medium transport section 34 and the medium placement section 35. The both aligning sections arrange and align left and right side ends 57L and 57R of the bundle of the mediums P by performing the predetermined stroke and shift operation in the medium width direction X by a shift mechanism that is not illustrated.

Further, the second side end aligning section 41 is a member that constitutes the medium supporting portion 50 as will be described below. A pair of left and right medium supporting portions 50 are provided to pinch the medium P in the medium width direction X, and are configured to be able to perform the predetermined stroke and shift operation in the medium width direction X by a shift mechanism that is not illustrated. Accordingly, the side ends 57L and 57R (FIG. 2) which are mainly side edges of the tip portion 53 of the medium P supported by the support surface 50*a* of the medium supporting portion 50 are aligned with each other.

Processing Element

The processing element of the processing device 4 includes the processing section 36 that executes a predetermined process on the medium P placed on the medium placement section 35.

The processing sections 36 illustrated in FIGS. 1 and 3 are provided as an example at three points including left and right corner portions and a central portion of the medium P at the rear end 59, and as described above, a predetermined process such as the stapling process, the punching process, the folding process, and the saddle stitching process is executed.

In the present embodiment, a configuration in which the stapling process is performed by driving a stapling needle that is not illustrated into one of the above-described three points of the medium P at the rear end 59 is adopted as an example. Accordingly, the processing section 36 is appropriately provided with an accommodation section that can accommodate a plurality of stapling needles, a mechanism that sends the stapling needles to a stapling position, and a mechanism that drives the stapling needles.

Discharging/Stacking Element

As described above, the discharging/stacking element of the processing device 4 includes the sheet discharging device 30, and the medium supporting portion 50 and the stacking portion 37 that are also the components thereof.

The sheet discharging device 30 basically executes: a sheet discharging operation (FIG. 7) of transferring, to the downstream +Ya in the sheet discharging direction Ya, the bundle of the mediums P having the portion on the rear end 59 side supported by the placement surface 35*a* of the medium placement section 35 and processed by the processing section 36, and positioning the rear end 59 side of the medium P onto the support surface 50*a* of the medium supporting portion 50; and a stacking operation (FIG. 8) of dropping and stacking, on the stacking surface 37*a* of the stacking portion 37 below the mediums P, the bundle of the mediums P discharged after the support by the medium supporting portion 50 is released.

Further, the sheet discharging device 30 performs a detection operation of identifying whether or not the medium supporting portion 50 swings and identifying a degree of the swinging by the detecting portion 100, in order to reduce the risk of contact between the lower surface 50*c* of the medium supporting portion 50 and the medium P due to deformation such as curl that occurs in the medium P after being stacked.

The medium supporting portion 50 is a medium support member in which a lower support section 70 having an upper surface serving as the support surface 50*a* and a side plate 101 having an inner wall surface serving as a regulation surface when the side ends 57L and 57R (FIG. 2) of the medium P are aligned with each other are integrally formed, and which has, for example, an L-shaped cross-sectional shape. The medium supporting portion 50 is provided in an inclined posture having an upward inclination in which the downstream +Ya side along the sheet discharging direction Ya is higher. The side plate 101 also functions as the second side end aligning section 41.

The medium supporting portions 50 are arranged to face each other on the left and right sides in the medium width direction X, and are configured to be able to perform a shift operation of a predetermined stroke in the medium width direction X as an example. In detail, in a state in which the medium P is supported, the left and right medium supporting portions 50L and 50R are both shifted inward to support the lower surface of the medium P near the side ends 57L and 57R.

On the other hand, when the support of the medium P is released and the bundle of the mediums P are dropped onto the stacking surface 37*a* of the stacking portion 37 therebelow, both the left and right medium supporting portions 50L and 50R are configured to be shifted outward and to be moved to the outside of an area where the medium P exists.

The stacking portion 37 includes an elevatable sheet discharging tray 71 that receives the bundle of the mediums P that has been released from the support by the medium supporting portion 50 and has dropped downward in the vertical direction Z.

As illustrated in FIG. 4, the sheet discharging tray 71 has the stacking surface 37*a* provided in an inclined posture having an upward inclination in which the downstream +Ya side along the sheet discharging direction Ya is higher, which is like the medium supporting portion 50. In a state in which the sheet discharging tray 71 is located at the uppermost position illustrated in FIG. 4, the sheet discharging tray 71 is configured to always maintain a constant distance between the stacking surface 37*a* and the medium supporting portion 50 and to stand by at a lower position thereof.

Further, a sensor 79 is provided in a housing 77 on a side of a base portion of the sheet discharging tray 71 when the sheet discharging tray 71 is located at the uppermost position. Then, in many cases, when the bundle of the mediums P are dropped onto the stacking surface 37*a* of the sheet discharging tray 71, the sensor 79 detects the presence of the medium P, and the sheet discharging tray 71 is configured to move downward in the vertical direction Z by a stacking height of the bundle of the medium P that has been dropped. Accordingly, when the support by the medium supporting portion 50 is released and the bundle of the mediums P are dropped, the dropping distance D is maintained substantially constant.

Pressing Element

As illustrated in FIGS. 2 to 5, the pressing element of the processing device 4 includes: the pressing section 51 that is provided above the medium supporting portion 50 in an inclined posture having an upward indication in which the downstream +Ya side along the sheet discharging direction Ya is higher, which is like the medium supporting portion 50; a pressing mechanism 80 that presses the pressing section 51 against the medium supporting portion 50 side; and holding frames 81R and 81L (FIGS. 2 and 3) that have side plates 109 configured to hold the pressing section 51 and the pressing mechanism 80 while being connected to the medium supporting portion 50 and are bent in an L shape as an example.

The pressing section 51 is a flat plate-like member that is disposed in parallel with the medium supporting portion 50 and is slightly smaller than the lower support section 70 of the medium supporting portion 50, and an inclined guide 83 that is bent upward such that the medium P is smoothly transported and discharged is formed at the upstream −Ya in the sheet discharging direction Ya.

Further, connection pieces 85A and 85B (FIG. 4) that are upwardly raised are provided at a downstream +Ya side position near the inclined guide 83 of the pressing section 51 and at a further downstream +Ya side position separated by a predetermined distance. The pressing section 51 is connected to the pressing mechanism 80, which will be described below, via these connection pieces 85A and 85B.

The pressing mechanism 80 includes: a motor that is not illustrated and serves as a drive source; a power transmission mechanism that is not illustrated and transmits rotation of an output shaft of the motor to the drive shaft 87; and a power conversion mechanism 89 that converts the rotation of the drive shaft 87 into an approaching and separating operation of the pressing section 51 with respect to the support surface 50*a* of the medium supporting portion 50.

Further, in the present embodiment, the power conversion mechanism 89 is configured by a parallel link mechanism. In detail, the power conversion mechanism 89 includes: a first link arm 90 that has one end fixedly connected to the drive shaft 87 and the other end rotatably connected to the connection piece 85B at a downstream +Ya position; a second link arm 93 that has the same length as that of the first link arm 90 and has one end rotatably connected to a rotary shaft 91 provided at a position separated from the upstream −Ya side of the drive shaft 87 and the other end rotatably connected to the connection piece 85A at an upstream −Ya position; and a gate-shaped support frame 95 as an example of supporting the drive shaft 87 and the rotary shaft 91 and supporting the motor that is not illustrated and the power transmission mechanism.

As a result, when the rotation of the output shaft of the motor that is not illustrated is transmitted to the drive shaft 87 via the power transmission mechanism, the first link arm 90 and the second link arm 93 maintain a parallel state with respect to the drive shaft 87 and the rotary shaft 91, and rotate in a clockwise direction or a counterclockwise direction in FIG. 4.

Further, the rotation of the first link arm 90 and the second link arm 93 is transmitted to the pressing section 51 via the two connection pieces 85A and 85B connected to the other end side, and the pressing surface 51*a* of the pressing section 51 is configured to be movable between the above-described retraction position Q1 and the pressed position Q2 closer to the support surface 50*a* than the retraction position Q1 while a parallel state between the pressing section 51 and the medium supporting portion 50 is maintained.

Detection Element

The detection element of the processing device 4 is an element that determines whether or not a curl of the medium P stacked on the stacking portion 37 exists and a degree of the curl by detecting the swinging of the medium supporting portion 50, and uses the determination result to control the sheet discharging device 30. In detail, as illustrated in FIGS. 3 and 4, the medium supporting portion 50, the stacking portion 37, and the detecting portion 100 are provided.

Further, a detailed configuration of the detection element will be described in a detailed configuration of the sheet discharging device, which will be described next.

Detailed Configuration of Sheet Discharging Device

As illustrated in FIGS. 3 and 4, the sheet discharging device 30 according to the present embodiment includes: the swingable medium supporting portion 50 that supports the transported medium P; the elevatable stacking portion 37 which is provided below the medium supporting portion 50 in the vertical direction Z and on which the medium P dropped from the medium supporting portion 50 is stacked; and the detecting portion 100 that detects the swinging of the medium supporting portion 50.

The stacking surface 37*a* of the stacking portion 37 is parallel to the lower surface 50*c* of the medium supporting portion 50, and the detecting portion 100 is configured to detect the swinging of the medium supporting portion 50 when the medium P on the rising stacking portion 37 comes into contact with the lower surface 50*c* of the medium supporting portion 50.

Here, the word "parallel" in the phrase "the stacking surface 37*a* of the stacking portion 37 is parallel to the lower surface 50*c* of the medium supporting portion 50" means that a surface formed by the medium P stacked on the stacking surface 37*a* is parallel to the lower surface 50*c* of the medium supporting portion 50. Further, the word "parallel" does not need to be strictly parallel, and may have a width within a range in which the purpose of detecting the presence or absence of deformation of the medium P due to the curling or the like based on the presence or absence of the swinging of the medium supporting portion 50 is achieved. Further, the stacking surface 37*a* of the stacking portion 37 is not necessarily parallel to the lower surface 50*c* of the medium supporting portion 50 depending on the size of the medium P and the deformation such as curl that is likely to occur.

Configuration of Medium Supporting Portion

Since a basic configuration of the medium supporting portion 50 has been already described, a configuration of a portion functioning as the detection element of the processing device 4 will be mainly described herein. In the present embodiment, the medium supporting portion 50 is attached to the holding frame 81 that holds the support frame 95 configured to support the pressing section 51 to be able to swing by a predetermined angle.

FIGS. 3 to 9 illustrate a state in which a swinging force is not applied to the medium supporting portion 50, and the posture of the medium supporting portion 50 is set to a predetermined angle in parallel to the stacking surface 37*a* of the stacking portion 37.

In detail, a reference hole 103 serving as a swinging center at the upstream −Ya position in the transport direction Ya is provided on the side plate 101 functioning as the second side end aligning section 41 raised upward from a side edge outside the lower support section 70 of the medium supporting portion 50. Further, in the side plate 101, two slots 105 and 107 for enabling the swinging of the medium supporting portion 50 are provided at a position near the downstream +Ya in the transport direction Ya and at a position near a central upper side thereof over a predetermined length to pass through a circle having a predetermined radius with the reference hole 103 as a center.

Then, connection screws 111, which are screwed into screw holes that are not illustrated and are formed in the side plates 109 of the holding frame 81, are attached to the reference hole 103 and the two slots 105 and 107, for example, in a loosely tightened state in order to enable the swinging of the medium supporting portion 50.

Further, a tension coil spring 113, which is an example of a biasing member, is attached to the vicinity of the slot 105 near the downstream +Ya in the transport direction Ya. The tension coil spring 113 biases the medium supporting portion 50 in a direction away from the stacking portion 37. Incidentally, by providing such a biasing member 113, the influence of the own weight of the medium supporting portion 50 on the medium P can be reduced, and the medium supporting portion 50 that can swing with high sensitivity even under a very small stack can be realized.

Further, a push-up lever 115 (FIGS. 2 to 4) that extends inward in the medium width direction X and has an L shape as an example is attached to the side plate 101 of the medium supporting portion 50. The swinging of the medium supporting portion 50 is configured to be transmitted to a flag lever 117, which will be described below, by this push-up lever 115.

Further, as described above, the pair of the medium supporting portions 50 are provided to face each other at opposite positions in the medium width direction X. Accordingly, the pair of push-up levers 115 are also provided to face each other.

Configuration of Stacking Portion

Since a basic configuration of the stacking portion 37 has already been described, a configuration of a portion functioning as the detection element of the processing device 4 will be mainly described here. In the present embodiment, the stacking portion 37 is configured to be able to elevate the sheet discharging tray 71 in the vertical direction Z as a preliminary operation of performing detection by the detecting portion 100, which will be described below, or a processing operation based on the detection information detected by the detecting portion 100 in addition to a basic operation of elevating the sheet discharging tray 71 in the vertical direction Z based on an instruction of the sensor 79 disposed in the housing 77.

Configuration of Detecting Portion

The detecting portion 100, which is disposed to face the medium P in the width direction X, includes: the flag lever 117 (FIGS. 3 and 12) that is in contact with the push-up lever 115 swinging integrally with the pair of medium supporting portions 50L and 50R movable in the width direction X of the medium P and swings in conjunction with the movement of the medium supporting portion 50; and a sensor 119 that senses the displacement of a flag 121 provided in the flag lever 117.

Further, the pair of medium supporting portions 50 are configured to be movable a predetermined position between a first position R1 which is an approaching position where the medium supporting portions 50 are closest to each other in the medium width direction X and a second position R2 which is a separation position where the medium supporting portions 50 are farthest away from each other, in order to support the plurality of mediums P having different widths caused by differences in the sizes and the directions of the mediums P accommodated in the medium accommodation cassette 7. Here, the reference signs R1 and R2 are used only in the description of the specification and do not appear in the drawings.

The flag lever 117 includes an extension body 123 extending in the medium width direction X and the flag 121 protruding from the extension body 123. The length S (FIG. 12) of the extension body 123 is formed in a length in which the extension body 123 can be in contact with the pair of medium supporting portions 50L and 50R located at the second position R2 where they are farthest away from each other via the pair of push-up levers 115 and 115 functioning as parts of the medium supporting portions 50L and 50R and protruding inward.

Figure 12:
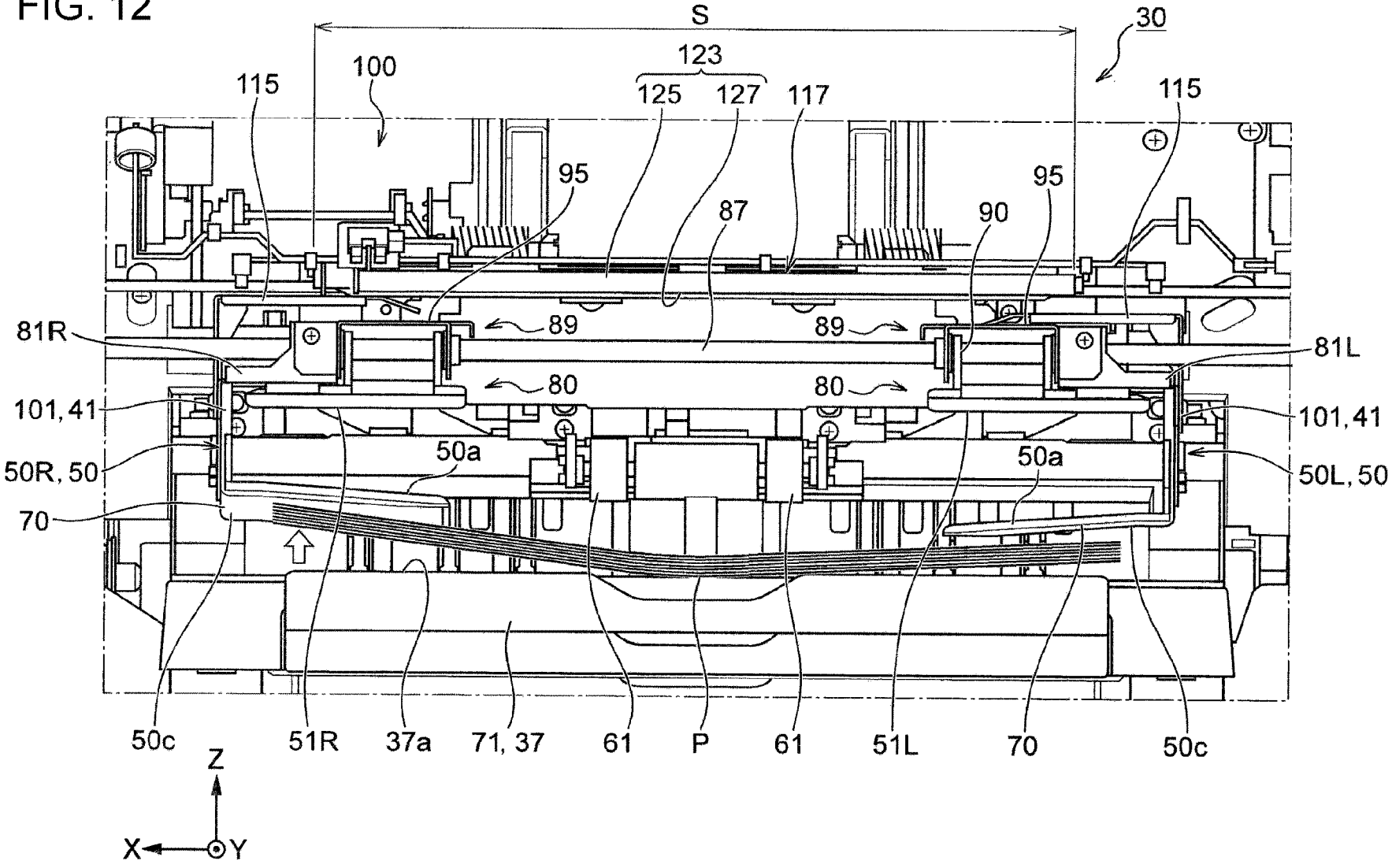
FIG. 12 is a view on arrow XII of FIG. 10 illustrating the sheet discharging device of the present embodiment.

In detail, as illustrated in FIGS. 3 and 12, the extension body 123 includes a swinging shaft 125 that is formed by a cylindrical rod-shaped member as an example and a flat plate-shaped passive wing plate 127 that protrudes and extends obliquely downward from the swinging shaft 125 on the upstream −Ya side in the sheet discharging direction Ya and is bent in the shape of a letter "V" as an example. Then, the length of the passive wing plate 127 is the above-described length S at which the pair of push-up levers 115 and 115 can be in contact with each other.

Further, as illustrated in FIG. 3, the flag 121 is formed by a rectangular flat plate-shaped member having rounded corners as an example, and is disposed to protrude and extend obliquely upward from the upstream −Ya side in the sheet discharging direction Ya at one end (for example, a left end) as an example of the swinging shaft 125 in the medium width direction X. Then, the sensor 119, which is configured by a U-shaped transmissive optical sensor as an example, is provided in arrangement in which an optical path is blocked when the detection is performed by the flag 121.

Explanation of Effect of Sheet Discharging Device

The sheet discharging device 30 according to the present embodiment has the above-described configuration, and thus the following effect can be obtained.

(1) First, in the present embodiment, the sheet discharging device 30 is configured by including the detecting portion 100 in addition to the medium supporting portion 50 and the stacking portion 37, the stacking surface 37*a* of the stacking portion 37 is parallel to the unstacked lower surface 50*c* of the medium supporting portion 50, and the detecting portion 100 is configured to detect the swinging of the medium supporting portion 50 when the medium P on the rising stacking portion 37 is in contact with the lower surface 50*c* of the medium supporting portion 50.

According to the present embodiment, when the medium P on the rising stacking portion 37 is flat without the deformation such as curl, the medium P is not in contact with the lower surface 50*c* of the medium supporting portion 50, and thus the medium supporting portion 50 does not swing.

However, when the medium P has the deformation such as curl, a portion deformed by the curl is firstly in contact with the lower surface 50*c* of the medium supporting portion 50, the other portion is not in contact with the lower surface 50*c*, and thus the medium supporting portion 50 swings. Then, the detecting portion 100 can detect that the medium P is deformed by the curl due to the swinging of the medium supporting portion 50. Further, since the extent of the deformation such as curl can be grasped from the degree of the swinging, it is possible to cope with the deformation.

Accordingly, a distance by which the stacking portion 37 is lowered can be appropriately determined according to the extent of the deformation, such as curl, occurring in the medium P, and thus the medium P stacked on the stacking portion 37 is in contact with the medium supporting portion 50, so that it is possible to suppress occurrence of a problem such as stacking deviation of the medium P and a problem such as malfunction of the medium supporting portion 50.

(2) Further, in the present embodiment, the medium supporting portion 50 has a swinging center on the upstream −Ya side in the transport direction Ya and includes a biasing member 113 that biases the medium supporting portion 50 on the downstream +Ya side in the transport direction Ya in a direction away from the stacking portion 37.

Then, when the medium supporting portion 50 swings about the swinging center as a supporting point, a biasing force of the biasing member 113 reduces a force by which the medium supporting portion 50 swings downward in the vertical direction Z due to its own weight, and when the deformed portion of the medium P that has undergone the deformation such as curl comes into contact with the medium supporting portion 50, the medium supporting portion 50 can swing upward in the vertical direction Z with a small force without the deformed portion being crushed.

According to the present embodiment, as compared to a structure, opposite to the above-described configuration, in which the medium supporting portion 50 swings on the upstream −Ya side with the downstream +Ya side in the transport direction Ya as the swinging center, it is possible to suppress the biasing force of the biasing member 113 from becoming excessive. Further, since the deformed portion such as curl occurring in the medium P tends to become larger on the downstream +Ya side in the transport direction Ya, it is possible to effectively arrange the biasing member 113 according to the tendency.

(3) Further, in the present embodiment, a pair of the medium supporting portions 50 are provided at positions where a lower surface on both left and right side ends 57L and 57R side of the medium P can be supported in the medium width direction X intersecting the transport direction Ya of the medium P, and the detecting portion 100 includes: the flag lever 117 that is in contact with the push-up levers 115 and 115 integral with the pair of medium supporting portions 50L and 50R and swings in conjunction with the medium supporting portions 50L and 50R; and the sensor 119 that senses the displacement of the flag 121 provided in the flag lever 117.

According to the present embodiment, the swinging of the medium supporting portion 50 can be grasped by the swinging of the flag lever 117 interlocked therewith, and the sensor 119 that senses the displacement of the flag 121 of the flag lever 117 is used, so that a swinging detection mechanism for the medium supporting portion 50, having a simple structure, can be provided.

Further, although the displacements of the left and right medium supporting portions 50L and 50R can be detected by two sensors without providing the flag lever 117, using the two sensors increases product costs, so that the configuration of the present embodiment can contribute to a reduction in the product costs.

(4) Further, in the present embodiment, the pair of medium supporting portions 50L and 50R movable in the medium width direction X can move between the first position R1 where they are closest to each other and the second position R2 where they are farthest apart from each other, and the flag lever 117 includes the extension body 123 extending in the medium width direction X and the flag 121 protruding from the extension body 123.

Further, the extension body 123 is formed to have the length S at which the extension body 123 can contact the two push-up levers 115 and 115 extending from the pair of medium supporting portions 50L and 50R located at the second position R2 that is the separation position.

According to the present embodiment, the swinging of the left and right medium supporting portions 50L and 50R can be detected using the single extension body 123 and the one sensor 119 without making the extension body 123 longer than a necessary length.

Contents of Method of Controlling Sheet Discharging Device

A method of controlling the sheet discharging device according to the present embodiment is a method of controlling operations of the medium supporting portion 50, the detecting portion 100, and the stacking portion 37 after being discharged and stacked in the above-described and configured sheet discharging device 30. This control includes: a first step P1 that is a supporting step of the medium P, a second step P2 that is a dropping step of the medium P, a third step P3 that is a stacking step of the medium P, a fourth step P4 that is a detection preparation step of the medium P, a fifth step P5 that is a contacting step of the medium P, a sixth step P6 that is a step of detecting the presence or absence of curling or the like of the medium P, and a processing step P7 that executes predetermined processing based on the detection result.

Further, in the present embodiment, an eighth step P8 that is a preliminary lowering step of lowering the stacking portion 37 by a predetermined distance is provided between the third step P3 that is the stacking step and the fourth step P4 that is the detection preparation step. Then, the control of each of these steps is performed by the controller 15. Hereinafter, the contents of these steps will be described below.

Figure 13:
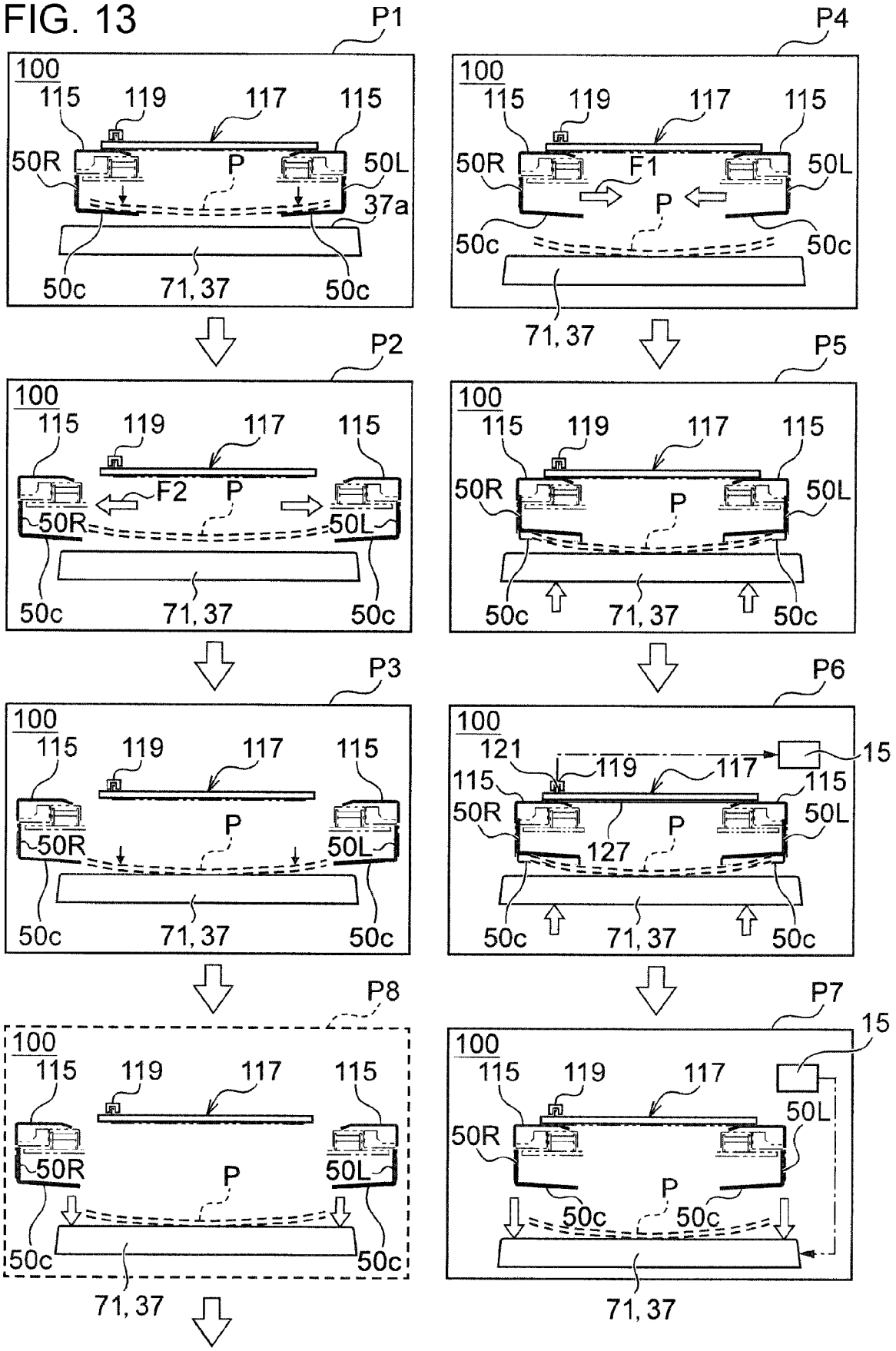
FIG. 13 is a process diagram illustrating a method of controlling the sheet discharging device according to the present embodiment.

First Step (P1 in FIG. 13)

The first step P1 is a supporting step of supporting the transported medium P by the pair of medium supporting portions 50L and 50R.

That is, by driving the motor that is not illustrated, an interval between the left and right medium supporting portions 50L and 50R in the medium width direction X is set to a predetermined interval corresponding to the orientation and the size of the used medium P, and the bundle of the medium P having been discharged and processed is brought into a state of being supported by the lower support section 70 of the medium supporting portions 50L and 50R.

Second Step (P2 in FIG. 13)

The second step P2 is the dropping step of, after the first step P1, dropping the medium P from the pair of medium supporting portions 50L and 50R by moving the pair of medium supporting portions 50L and 50R to an outside F2 in the medium width direction X intersecting the transport direction Ya.

That is, by driving the motor that is not illustrated, an interval between the left and right medium supporting portions 50L and 50R in the medium width direction X is open to an interval larger than the width dimension of the medium P being supported, and the supported medium P is dropped downward in the vertical direction Z.

Third Step (P3 in FIG. 13)

The third step P3 is a step of receiving, by the stacking portion 37, the medium P dropped by the second step P2 and stacking the medium P on the stacking surface 37*a*.

In this case, the stacking portion 37 is raised to be located at the uppermost position set by the sensor 79 and stands by, receives the medium P dropped from above, and stacks the medium P on the stacking surface 37*a* thereof.

Eighth Step (P8 in FIG. 13)

The eighth step P8 is a preliminary lowering step of, after the third step P3, lowering the stacking portion 37 by a predetermined distance. This eighth step P8 may be omitted when the eighth step P8 is not required depending on the type of the medium P or the like.

That is, when the bundle of the medium P is dropped and stacked on the sheet discharging tray 71 of the stacking portion 37, the stacking of the medium P is identified by the sensor 79, the sheet discharging tray 71 is lowered by a predetermined distance set in advance, and the fourth step P4 that is a next step is prepared.

Fourth Step (P4 in FIG. 13)

The fourth step P4 is a detection preparation step of, after the third step P3 or the eighth step P8, moving the pair of medium supporting portions 50L and 50R in an approaching direction F1 opposite to a case where the medium P is dropped and stopping the medium supporting portions 50L and 50R.

That is, by driving the motor that is not illustrated, the pair of medium supporting portions 50L and 50R, in a state of being separated to the outside R2 from the width dimension of the medium P dropped on the stacking portion 37, are moved to an inside R1, are brought to a position where the medium supporting portions 50L and 50R can come into contact with the curl of the medium P to be performed next, and are stopped.

Fifth Step (P5 in FIG. 13)

The fifth step P5 is a contact step of, after the fourth step P4, bringing the medium P stacked on the stacking surface 37*a* into contact with the lower surface 50*c* of the medium supporting portion 50 located above, by raising the stacking portion 37.

That is, by driving the motor that is not illustrated, the sheet discharging tray 71 of the stacking portion 37 is raised, and thus the medium P stacked on the sheet discharging tray 71 is brought into contact with the lower surface 50*c* of the lower support section 70 of the medium supporting portion 50 located above.

Sixth Step (P6 in FIG. 13)

The sixth step P6 is a detection step of detecting the presence or absence of the swinging of the medium supporting portion 50 caused by the contact between the medium P and the lower surface 50*c* of the medium supporting portion 50 in the fifth step P5.

That is, when the medium P contacts the lower surface 50*c* of the medium supporting portion 50 and the medium supporting portion 50 does not swing, it is determined that the medium P on the stacking portion 37 does not have the deformed portion such as curl, and this fact is output as the detection result.

On the other hand, when the medium P contacts the lower surface 50*c* of the medium supporting portion 50 and the medium supporting portion 50 swings, it is determined that the medium P on the stacking portion 37 has the deformed portion such as curl, and this fact and a swinging angle at that time are output as the detection result.

Seventh Step (P7 in FIG. 13)

The seventh step P7 is a processing step of executing predetermined processing based on the detection result obtained in the sixth step P6.

That is, when the medium P is flat without the deformed portion such as curl, the upper surface of the medium P evenly contacts the lower surface 50*c* of the medium supporting portion 50, so that the medium supporting portion 50 does not swing. As a process in this case, the descending distance of the stacking portion 37 is set to a predetermined distance set in advance.

On the other hand, when the medium P has the deformed portion such as curl, a portion having the deformed portion firstly comes into contact with the lower surface 50*c* of the medium supporting portion 50, so that the medium supporting portion 50 swings about the swinging center as a supporting point at a predetermined angle. As a process in this case, the descending distance of the stacking portion 37 is set such that the stacking portion 37 descends by a predetermined distance corresponding to the swinging angle.

The predetermined distance corresponding to the swinging angle is obtained by adding the size of the deformed portion such as curl generated in the medium P to a predetermined distance set in advance when there is no swinging. Further, examples of a predetermined process performed in the present step include: adjusting an ascending distance of the stacking portion 37; notifying the presence or the size of the deformed portion such as curl of the medium P by a monitor display or a warning sound; stopping an operation of the medium supporting portion 50; and forcibly stopping recording and transport of the medium P, in addition to the adjusting of the descending distance of the stacking portion 37 described herein.

Explanation of Effect of Method of Controlling Sheet Discharging Device (5) First, after the three steps including the first step P1 to the third step P3 in which the sheet discharging device 30 is normally operated, the four steps including the fourth step P4 to the seventh step P7 in which a state of the stacked medium P is detected and the medium P is processed are provided, so that it is possible to suppress a defect such as a failure that occurs when the medium P stacked between the sheet discharging tray 71 and the medium supporting portion 50 is pinched.

Further, it is possible to suppress the stacking deviation of the medium P caused by the movement of the medium supporting portion 50 in a state in which the medium P is in contact with the medium supporting portion 50 or is likely to be brought into contact with the medium supporting portion 50 by the movement. Further, a possibility that the stacked medium P is dropped due to contact between the medium supporting portion 50 and the medium P when the medium supporting portion 50 moves in the medium width direction X is suppressed.

(6) Further, when the detection result in the sixth step P6 is that there is no swinging, the stacking portion 37 is lowered by a predetermined distance set in advance. When the detection result is that there is the swinging, if the stacking portion 37 is lowered by a predetermined distance according to the degree of the swinging, even when the deformed portion such as curl occurring on the medium P becomes larger, the stacking portion 37 is lowered by a distance corresponding to the size of the deformed portion. Thus, it is possible to suppress the contact between the medium P on the stacking portion 37 and the medium supporting portion 50, and to reduce problems such as the stacking deviation caused by the contact.

(7) Further, after the bundle of the medium P is stacked on the stacking portion 37 in the third step P3, the eighth step P8 of lowering the stacking portion 37 by a predetermined distance is provided. Thereafter, when the fourth step P4 of moving the medium supporting portion 50 in the approaching direction R1 is executed, it is possible to reduce a concern that the medium supporting portion 50 moving in the approaching direction R1 comes into contact with the medium P stacked on the stacking portion 37. Accordingly, it is possible to further suppress problems such as the stacking deviation of the medium P caused by the contact.

Other Embodiments

Although the sheet discharging device 30, the method of controlling the sheet discharging device, the processing device 4, and the recording system 1 according to the embodiment of the present disclosure basically have the above-described configurations, a partial configuration may be changed or omitted without departing from the scope of the present disclosure.

For example, as another configuration in which the medium supporting portion 50 is swingable, a configuration that is opposite to the above-described embodiment is provided, the reference hole 103 and the two slots 105 and 107 as an example may be provided on the holding frame 81 side, and a screw hole may be provided on the medium supporting portion 50 side. Further, a swing link mechanism or the like can be applied as another configuration that allows the medium supporting portion 50 to be swingable.

Further, a stepped screw having an unbroken screw portion on a base portion side may be used as the connection screw 111 connecting the holding frame 81 and the medium supporting portion 50. In this case, even when the screw is tightened, the medium supporting portion may smoothly swing. Further, a section connecting the holding frame 81 and the medium supporting portion 50 is not limited to the connection screw 111. For example, a section using a connection pin or an concave-convex engagement section in which a convex portion and a concave portion are engaged with each other to perform a guide action may be adopted. In addition, a torsion coil spring can be adopted as the biasing member 113. In this case, a coil portion of the torsion coil spring is fitted in the connection screw 111 or the like attached to the reference hole 103 serving as a swinging center, and the fitted component is used.

In the recording system 1, the intermediate device 3 may be omitted, in which case the recording device 2 and the processing device 4 may be independent sections or the recording device 2 and the processing device 4 may be integrated. Further, the sheet discharging device 30 may be mounted on the recording device 2.

What is claimed is:

1. A sheet discharging device comprising:

a medium supporting portion configured to support a medium transported in a transport direction, the medium supporting portion being configured to swing;

a stacking portion which is provided vertically below the medium supporting portion and on which the medium dropped from the medium supporting portion is stacked, the stacking portion being configured to move up and down; and a detecting portion that detects swinging of the medium supporting portion, wherein the detecting portion detects the swinging of the medium supporting portion when the medium on the rising stacking portion comes into contact with a lower surface of the medium supporting portion.

2. The sheet discharging device according to claim 1, wherein the medium supporting portion has a swinging center on an upstream in the transport direction, and includes a biasing member that biases the medium supporting portion in a direction away from the stacking portion on a downstream in the transport direction.

3. The sheet discharging device according to claim 1, wherein a pair of the medium supporting portions are provided at positions supporting both sides of the medium in a width direction intersecting the transport direction, and the detecting portion has a flag lever that interlocks with the pair of swinging medium supporting portions, and a sensor that senses displacement of a flag provided on the flag lever.

4. The sheet discharging device according to claim 3, wherein the pair of medium supporting portions are movable between a first position where the medium supporting portions are closest to each other in the width direction and a second position where the medium supporting portions are farthest away from each other, the flag lever includes an extension body that extends in the width direction, and the flag that protrudes from the extension body, and the extension body has a length that makes contact with the pair of medium supporting portions located at the second position.

5. A method of controlling a sheet discharging device including:

a pair of medium supporting portions configured to support a medium transported in a transport direction, the medium supporting portion being configured to swing;

a stacking portion which is provided vertically below the pair of medium supporting portions and on which the medium dropped by moving the pair of medium supporting portions in a width direction intersecting the transport direction is stacked, the stacking portion being configured to move up and down; and a detecting portion that detects swinging of the medium supporting portions, the method comprising:

supporting the transported medium by using the pair of medium supporting portions;

dropping the medium supported by the pair of medium supporting portions by moving the pair of medium supporting portions in the width direction;

receiving the dropped medium on the stacking portion and stacking the received medium on a stacking surface;

after stacking, on the stacking surface, the medium dropped from the pair of medium supporting portions, moving the pair of medium supporting portions in a direction opposite to a direction at a time of the dropping, and stopping the medium supporting portions;

bringing the medium on the stacking surface into contact with lower surfaces of the medium supporting portions by raising the stacking portion after stopping the pair of medium supporting portions;

detecting presence or absence of the swinging of the medium supporting portions due to the contact of the medium; and lowering the stacking portion based on a detection result.

6. The method of controlling a sheet discharging device according to claim 5, wherein when the detection result indicates that there is no swinging, the stacking portion is lowered by a predetermined distance set in advance, and when the detection result indicates that there is the swinging, the stacking portion is lowered by a distance according to a degree of the swinging.

7. The method of controlling a sheet discharging device according to claim 5, further comprising:

lowering the stacking portion by a predetermined distance before moving the pair of medium supporting portions in the direction opposite to the direction at a time of the dropping.

8. A processing device comprising:

a processing section that performs processing on a medium;

a medium supporting portion configured to support the medium transported in a transport direction from the processing section, the medium supporting portion being configured to swing;

a stacking portion which is provided vertically below the medium supporting portion and on which the medium dropped from the medium supporting portion is stacked, the stacking portion being configured to move up and down; and a detecting portion that detects swinging of the medium supporting portion, wherein the detecting portion detects the swinging of the medium supporting portion when the medium on the rising stacking portion comes into contact with a lower surface of the medium supporting portion.

9. A recording system comprising:

a recording device including a recording section that performs recording on a medium, and a discharging portion that discharges the medium on which recording is performed by the recording section; and a processing device including a medium introducing portion that introduces the medium discharged from the discharging portion, a processing section that performs processing on the medium introduced from the medium introducing portion, a medium supporting portion configured to support the medium transported in a transport direction from the processing section, the medium supporting portion being configured to swing, a stacking portion which is provided vertically below the medium supporting portion and on which the medium dropped from the medium supporting portion is stacked, the stacking portion being configured to move up and down, and a detecting portion that detects swinging of the medium supporting portion, wherein the detecting portion detects the swinging of the medium supporting portion when the medium on the rising stacking portion comes into contact with a lower surface of the medium supporting portion.

* * * * *